US011504992B2

(12) United States Patent
Tomura et al.

(10) Patent No.: US 11,504,992 B2
(45) Date of Patent: Nov. 22, 2022

(54) IMAGE FORMING METHOD, RECORDED MATTER, AND IMAGE FORMING APPARATUS

(71) Applicant: RICOH COMPANY, LTD., Tokyo (JP)

(72) Inventors: Tatsuya Tomura, Tokyo (JP); Yoshimasa Miyazawa, Kanagawa (JP); Takuya Fujita, Aichi (JP)

(73) Assignee: RICOH COMPANY, LTD., Tokyo (JP)

( * ) Notice: Subject to any disclaimer, the term of this patent is extended or adjusted under 35 U.S.C. 154(b) by 10 days.

(21) Appl. No.: 16/043,702

(22) Filed: Jul. 24, 2018

(65) Prior Publication Data

US 2019/0030940 A1 Jan. 31, 2019

(30) Foreign Application Priority Data

Jul. 28, 2017 (JP) ..... JP2017-146530
Apr. 16, 2018 (JP) ..... JP2018-078361

(51) Int. Cl.

| | |
|---|---|
| ***B41M 5/00*** | (2006.01) |
| ***B41M 5/50*** | (2006.01) |
| ***B41M 5/52*** | (2006.01) |
| ***B41J 11/00*** | (2006.01) |
| *B41M 3/00* | (2006.01) |

(52) U.S. Cl.

CPC ..... *B41M 5/502* (2013.01); *B41J 11/0015* (2013.01); *B41M 5/0011* (2013.01); *B41M 5/0023* (2013.01); *B41M 5/5218* (2013.01); *B41M 3/008* (2013.01)

(58) Field of Classification Search

None

See application file for complete search history.

(56) References Cited

U.S. PATENT DOCUMENTS

| | | | | |
|---|---|---|---|---|
| 6,013,603 | A * | 1/2000 | Asajima | G03G 7/0006 428/500 |
| 8,294,040 | B2 * | 10/2012 | Shimizu | B32B 5/18 174/261 |
| 9,114,665 | B2 * | 8/2015 | Ohashi | B44C 1/1704 |
| 10,015,890 | B2 * | 7/2018 | Kaizu | H05K 3/12 |
| 2012/0147085 | A1 * | 6/2012 | Hirata | D06Q 1/04 347/20 |

(Continued)

FOREIGN PATENT DOCUMENTS

| | | |
|---|---|---|
| JP | 2003-306625 | 10/2003 |
| JP | 2004-207558 | 7/2004 |

(Continued)

OTHER PUBLICATIONS

Japanese Office Action dated Dec. 21, 2021 in Japanese Application 2018-078361, with English Translation, 14 pages.

*Primary Examiner* — Alejandro Valencia

(74) *Attorney, Agent, or Firm* — Grüneberg and Myers, PLLC

(57) ABSTRACT

An image forming method is provided. The image forming method includes the processes of: applying a porous layer forming material to a recording medium by an inkjet head to form a porous layer having an average pore diameter greater than 200 nm and not greater than 400 nm and an average thickness of from 5 to 30 μm; and applying a silver ink containing silver to the porous layer.

12 Claims, 4 Drawing Sheets

(56) References Cited

U.S. PATENT DOCUMENTS

| | | | | |
|---|---|---|---|---|
| 2014/0170395 | A1* | 6/2014 | Kasperchik | C09D 11/322 428/204 |
| 2015/0138270 | A1* | 5/2015 | Einhorn | B41M 3/14 347/20 |
| 2017/0355187 | A1* | 12/2017 | Hashimoto | B41J 2/04586 |
| 2018/0056692 | A1* | 3/2018 | Tomura | B41M 5/0047 |
| 2018/0094155 | A1 | 4/2018 | Fujita et al. | |
| 2018/0118966 | A1 | 5/2018 | Tomura et al. | |

FOREIGN PATENT DOCUMENTS

| | | |
|---|---|---|
| JP | 2006-299329 | 11/2006 |
| JP | 2007126012 | 11/2007 |
| JP | 2007297423 | 11/2007 |
| JP | 2009-107283 | 5/2009 |
| JP | 2011241240 | 12/2011 |
| JP | 2012-035590 | 2/2012 |
| JP | 2012-161959 | 8/2012 |
| JP | 2013071277 | 4/2013 |
| JP | 2013237850 | 11/2013 |
| JP | 2016-135600 | 7/2016 |
| JP | 2017149942 | 8/2017 |
| JP | 2018-039206 | 3/2018 |

* cited by examiner

IMAGE FORMING METHOD, RECORDED MATTER, AND IMAGE FORMING APPARATUS

CROSS-REFERENCE TO RELATED APPLICATIONS

This patent application is based on and claims priority pursuant to 35 U.S.C. § 119(a) to Japanese Patent Application Nos. 2017-146530 and 2018-078361, filed on Jul. 28, 2017 and Apr. 16, 2018, respectively, in the Japan Patent Office, the entire disclosure of each of which is hereby incorporated by reference herein.

BACKGROUND

Technical Field

The present disclosure relates to an image forming method, recorded matter, and an image forming apparatus.

Description of the Related Art

Print media have become more diverse recently. Varieties of print media are widely used in many fields, such as office printing, commercial printing, and large-scale printing.

Printed matter printed on such a print medium is capable of expressing a full-color image in which multiple colors are mixed.

Printed mater having metallic luster, particularly printed matter having an image containing a silver colorant having high specular image clarity, is capable of providing images having high image clarity by mixing the silver colorant with other colorants. Such a printed matter has high potential in industrial use.

SUMMARY

In accordance with some embodiments of the present invention, an image forming method is provided. The image forming method includes the processes of: applying a porous layer forming material to a recording medium by an inkjet head to form a porous layer having an average pore diameter greater than 200 nm and not greater than 400 nm and an average thickness of from 5 to 30 μm; and applying a silver ink containing silver to the porous layer.

In accordance with some embodiments of the present invention, recorded matter is provided. The recorded matter comprises a recording medium, a porous layer on the recording medium, and silver on the porous layer. The porous layer has an average pore diameter greater than 200 nm and not greater than 400 nm and an average thickness of from 5 to 30 μm.

In accordance with some embodiments of the present invention, an image forming apparatus is provided. The image forming apparatus includes a porous layer forming device and a silver ink applying device. The porous layer forming device is configured to apply a porous layer forming material to a recording medium to form a porous layer having an average pore diameter greater than 200 nm and not greater than 400 nm and an average thickness of from 5 to 30 μm. The silver ink applying device is configured to apply a silver ink containing silver to the porous layer.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
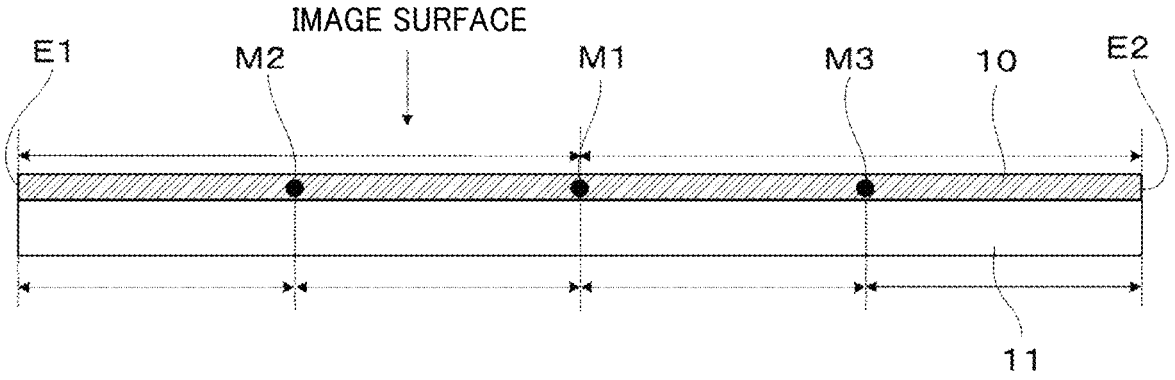
FIG. 1 is a schematic diagram for explaining a method for calculating an average thickness of a porous layer.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

In accordance with some embodiments of the present invention, an image forming method is provided that has compatibility for a wide variety of recording media and provides recorded matter having excellent metallic luster and image clarity. Image Forming Method and Image Forming Apparatus The image forming method according to an embodiment of the present invention includes a porous layer forming process and a silver ink applying process. Preferably, the image forming method further includes at least one of a color ink applying process and a laminate layer forming process. The image forming method may optionally include other processes.

The image forming apparatus according to an embodiment of the present invention includes a porous layer forming device and a silver ink applying device. Preferably, the image forming apparatus further includes at least one of a color ink applying device and a laminate layer forming device. The image forming apparatus may optionally include other devices.

Silver inks used for conventional image forming methods may contain a dispersant for improving dispersion stability of silver particles since they easily precipitate. When such a silver ink is applied to a recording medium having no ink receiving layer, a problem may arise that a large amount of the dispersant remains on the image surface to suppress metallic gloss.

When a porous layer is formed as the ink receiving layer on the recording medium but the average pore diameter and the average thickness of the porous layer are not appropriate, another problem may arise that appropriate image clarity cannot be achieved.

Further, when an impermeable substrate having no ink receiving layer is used as a recording medium, high image clarity cannot be achieved, and in particular, metallic luster and image clarity cannot be maintained for an extended period of time.

In view of the above situation, some embodiments of the present invention provide an image forming method that has compatibility for a wide variety of media, including a recording medium having no ink receiving layer and a recording medium having no appropriate ink receiving layer, and provides recorded matter having excellent metallic luster and image clarity.

Porous Layer Forming Process and Porous Forming Device

The porous layer forming process is a process in which a porous layer forming material is applied to a recording medium to form a porous layer having an average pore diameter greater than 200 nm and not greater than 400 nm and an average thickness of from 5 to 30 μm. The porous layer forming process is preferably performed by the porous layer forming device such as an inkjet head.

The porous layer forming process may also be performed by a bar coater in place of the inkjet head.

The porous layer forming device may be a device that applies the porous layer forming material to a recording medium by an inkjet head or a bar coater.

It is preferable that the image forming method further includes a drying process for drying the solvent contained in the porous layer forming material after the porous layer forming material has been applied to the recording medium. The drying process may employ, for example, hot air drying or natural drying.

An inkjet head as the porous layer forming device may be separately provided from an inkjet head as the silver ink applying device. Alternatively, separate nozzle rows on the same inkjet head may be respectively used by the porous layer forming device and the silver ink applying device.

Porous Layer

The porous layer is formed with the porous layer forming material on a recording medium. The porous layer has an average pore diameter greater than 200 nm and not greater than 400 nm and an average thickness of from 5 to 30 μm.

The porous layer has pores that absorb a solution and a resin contained in the ink without absorbing silver in the ink.

In the present disclosure, the pores refer to voids observable when the porous layer formed on the recording medium is observed from the porous-layer-formed surface side. The pores may be observed by observing the porous layer on the recording medium with a scanning electron microscope (SEM) to obtain a SEM image.

In the present disclosure, the pore diameter refers to the average value ((a+b)/2) of the longest diagonal line a (e.g., 101 in FIG. 1) and the shortest diagonal line b (e.g., 102 in FIG. 1) of the pore (e.g., 100 in FIG. 1). The lengths of the diagonal lines can be obtained from the SEM image of the porous layer.

The average pore diameter of the porous layer refers to the average of the pore diameters of the pores. In calculating the average pore diameter, the pore diameters which are equal to or less than 100 nm are not taken into consideration for the calculation. Specifically, the average pore diameter is calculated from voids observed in a 10-μm-square porous region to which neither silver ink nor color ink is attached in the above-obtained SEM image of the surface of recorded matter.

Figure 2:
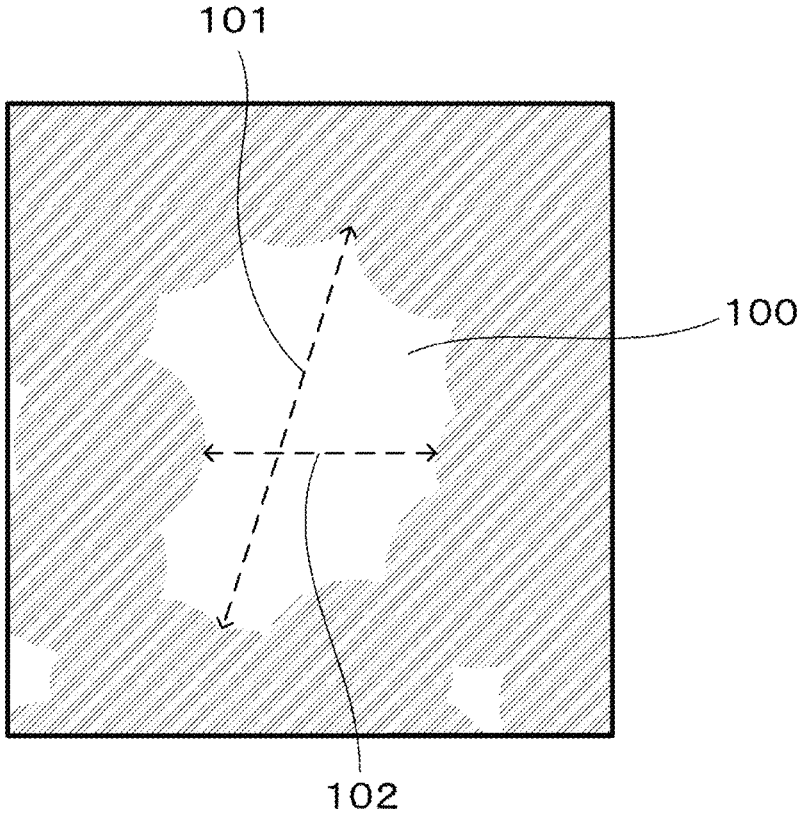
FIG. 2 is a schematic diagram for explaining a method for calculating an average pore diameter of a porous layer.

The average thickness of the porous layer is calculated from a SEM image of a cross-sectional surface of the dried recorded matter cut in a vertical direction. Specifically, the average thickness refers to the average of the thicknesses at the following three points in a cross-section of a region where a porous layer 10 is formed on a recording medium 11 as illustrated in FIG. 2: a midpoint M1 of the region, a midpoint M2 between one end E1 of the region and the midpoint M1, and a midpoint M3 between the other end E2 of the region and the midpoint M1.

Regions in the porous layer where the average pore diameter is not greater than 200 nm or greater than 400 nm are not taken into consideration in calculating the average thickness of the porous layer. Also, a coating layer formed in advance on the recording medium, if any, is not taken into consideration in calculating the average thickness of the porous layer.

The average pore diameter of the porous layer is greater than 200 nm and not greater than 400 nm, preferably in a range of from 201 to 400 nm, more preferably from 220 to 360 nm, and even more preferably from 250 to 360 nm.

When the average pore diameter is 200 nm or less, vehicles such as a solvent and a dispersant cannot be sufficiently absorbed to the pores and image clarity cannot be achieved. When the average pore diameter is in excess of 400 nm, the amount of silver falling into the pores increases, and therefore image clarity cannot be achieved.

When the average pore diameter is greater than 200 nm and not greater than 400 nm, the solution of the ink containing silver can be efficiently absorbed to the pores and recorded matter having high image clarity and excellent metallic luster can be obtained.

The average thickness of the porous layer is from 5 to 30 μm. The lower limit thereof is preferably 10 μm or more, more preferably 20 μm or more. The upper limit thereof is preferably 25 μm or less.

When the average thickness is less than 5 μm, vehicles such as a solvent and a dispersant cannot be sufficiently absorbed to the pores and image clarity cannot be achieved.

When the average thickness is in excess of 30 μm, smoothness is lowered and metallic luster and image clarity cannot be achieved, as well as the porous layer may be detached from the recording medium.

When the average thickness is from 5 to 30 μm, vehicles such as a solvent and a dispersant of a silver ink applied to the porous layer can be efficiently absorbed to the pores and recorded matter having excellent image clarity and metallic luster can be obtained.

The pore diameter and average thickness of the porous layer can be controlled by adjusting the concentrations of solid contents (e.g., silica and alumina) in the porous layer forming material or the application amount of the porous layer forming material to the recording medium.

Porous Layer Forming Material

The porous layer forming material is not particularly limited as long as it can be applied to a recording medium and formed into a porous layer having an average pore diameter greater than 200 nm and not greater than 400 nm and an average thickness of from 5 to 30 μm. Preferably, the porous layer forming material comprises silica or alumina that has excellent safety as well as excellent film formability, film uniformity, and adhesiveness on/to recording media such as paper, resin substrates (e.g., polyethylene terephthalate (PET) and vinyl chloride), and non-absorptive recording media. A commercially available recording medium having a coating layer containing silica or alumina may be used. In this case, the porous layer according to an embodiment of the present invention may be formed by applying the porous layer forming material to the coating layer.

Physical properties of the porous layer forming material, such as viscosity and surface tension, can be controlled by adjusting by the particle diameter of solid contents such as alumina and silica and the types of solvents and surfactants. By controlling the physical properties of the porous layer forming material, the porous layer forming material can be adjusted to have appropriate discharge property from an inkjet head.

The materials forming the porous layer, such as alumina and silica, can be detected by fluorescent X-ray analysis.

Preferably, the porous layer forming material contains at least one of silica and alumina, and optionally contains other components such as a solvent, a resin, a surfactant, a defoamer, a preservative, a fungicide, a corrosion inhibitor, and a pH adjuster, if needed.

Examples of the solvent include, but are not limited to, organic solvents and water.

In addition, commercially available sol-like or gel-like coating materials of silica and alumina may also be used.

Silica or Alumina Coating Agent

Silica or alumina serving as a coating agent may have a spherical shape. Such spherical particles may be connected into a rosary-like shape or a branched shape (e.g., a chain-like shape, a pearl-necklace-like shape).

The surface of the coating agent may be modified with an ion or compound of ammonia, calcium, alumina, etc.

Specific examples of silica coating agents include, but are not limited to: SNOWTEX® series S, N, UP, ST-XS, ST-O, ST-C, and ST-20 (available from Nissan Chemical Industries, Ltd.); CATALOID series SI-350, SI-30, SN, SA, S-20L, S-20H, S-30L, and S-30H (available from JGC Catalysts and Chemicals Ltd.); and AEROSIL® series 200, 200V, 200CF, and 300 (available from Nippon Aerosil Co., Ltd.). Specific examples of alumina coating agents include, but are not limited to, ALUMINA CLEAR SOL 5S, F1000, F3000, and A2 (available from Kawaken Fine Chemicals Co., Ltd.).

The porous layer is preferably formed by an inkjet method, but may also be formed by applying the porous layer forming material to a recording medium by blade coating, gravure coating, bar coating, roll coating, dip coating, curtain coating, slide coating, die coating, or spray coating.

Figure 3:
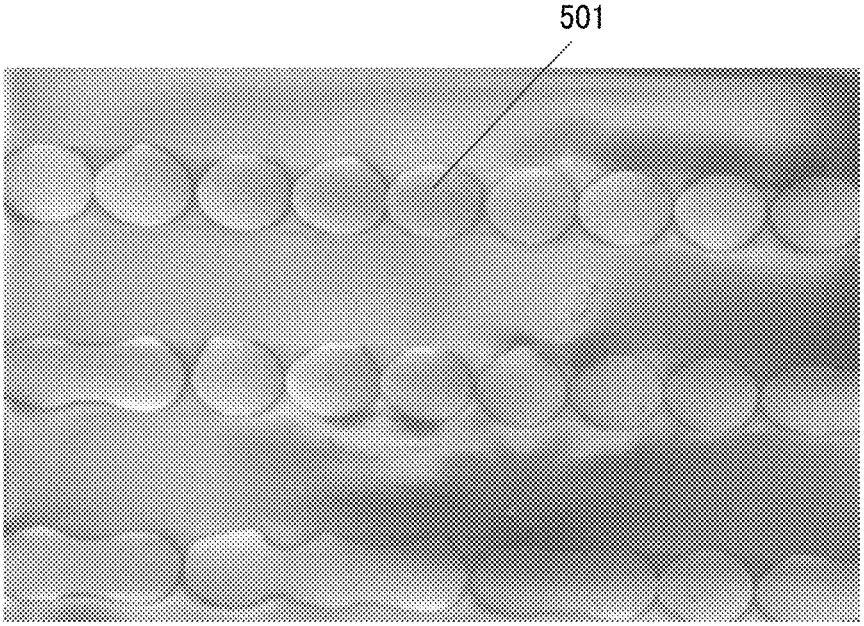
FIG. 3 is a scanning electron microscope (SEM) image of the surface of a recording medium to which a silver ink is applied by an inkjet head.

The inkjet method is capable of selectively forming the porous layer only at a portion to which metallic gloss is desired (a portion to which a silver ink is to be applied), so that the production efficiency is high. When the porous layer forming material is applied to a recording medium by the inkjet method, characteristic droplet marks are observed in a SEM image of the resulting recorded matter. For example, a droplet mark 501 as illustrated in FIG. 3 is observed.

The porous layer as prepared above may be dried naturally at room temperature or heated to promote drying. The drying temperature is preferably in a range of from 30° C. to 80° C., and more preferably from 40° C. to 70° C., for improving drying property of the porous layer forming material and preventing a viscosity increase of liquid components in the vicinity of the nozzle of the head.

Organic Solvent

There is no specific limitation on the type of the organic solvent. For example, water-soluble organic solvents are usable. Examples thereof include polyols, ethers (e.g., polyol alkyl ethers and polyol aryl ethers), nitrogen-containing heterocyclic compounds, amides, amines, and sulfur-containing compounds.

Specific examples of the water-soluble organic solvents include, but are not limited to, polyols such as ethylene glycol, diethylene glycol, 1,2-propanediol, 1,3-propanediol, 1,2-butanediol, 1,3-butanediol, 1,4-butanediol, 2,3-butanediol, 3-methyl-1,3-butanediol, triethylene glycol, polyethylene glycol, polypropylene glycol, 1,2-pentanediol, 1,3-pentanediol, 1,4-pentanediol, 2,4-pentanediol, 1,5-pentanediol, 1,2-hexanediol, 1,6-hexanediol, 1,3-hexanediol, 2,5-hexanediol, 1,5-hexanediol, glycerin, 1,2,6-hexanetriol, 2-ethyl-1,3-hexanediol, ethyl-1,2,4-butanetriol, 1,2,3-butanetriol, 2,2,4-trimethyl-1,3-pentanediol, and 3-methyl-1,3,5-pentanetriol; polyol alkyl ethers such as ethylene glycol monoethyl ether, ethylene glycol monobutyl ether, diethylene glycol monomethyl ether, diethylene glycol monoethyl ether, diethylene glycol monobutyl ether, tetraethylene glycol monomethyl ether, and propylene glycol monoethyl ether; polyol aryl ethers such as ethylene glycol monophenyl ether and ethylene glycol monobenzyl ether; nitrogen-containing heterocyclic compounds such as 2-pyrrolidone, N-methyl-2-pyrrolidone, N-hydroxyethyl-2-pyrrolidone, 1,3-dimethyl-2-imidazolidinone, ε-caprolactam, and γ-butyrolactone; amides such as formamide, N-methylformamide, N,N-dimethylformamide, 3-methoxy-N,N-dimethyl propionamide, and 3-butoxy-N,N-dimethyl propionamide; amines such as monoethanolamine, diethanolamine, and triethylamine; sulfur-containing compounds such as dimethyl sulfoxide, sulfolane, and thiodiethanol; propylene carbonate; and ethylene carbonate.

In particular, organic solvents having a boiling point of 250° C. or less are preferable, since they can function as a wetting agent while providing good drying property.

In addition, polyol compounds having 8 or more carbon atoms and glycol ether compounds are also preferable.

Specific examples of the polyol compounds having 8 or more carbon atoms include, but are not limited to, 2-ethyl-1,3-hexanediol and 2,2,4-trimethyl-1,3-pentanediol.

Specific examples of the glycol ether compounds include, but are not limited to, polyol alkyl ethers such as ethylene glycol monoethyl ether, ethylene glycol monobutyl ether, diethylene glycol monomethyl ether, diethylene glycol monoethyl ether, diethylene glycol monobutyl ether, tetraethylene glycol monomethyl ether, and propylene glycol monoethyl ether; and polyol aryl ethers such as ethylene glycol monophenyl ether and ethylene glycol monobenzyl ether.

In particular, the polyol compounds having 8 or more carbon atoms and the glycol ether compounds, exemplified above, are capable of improving paper-permeability of the porous layer forming material, which is advantageous when paper is used as a recording medium.

Preferably, the content rate of the organic solvent in the porous layer forming material is in the range of from 10% to 60% by mass, more preferably from 20% to 60% by mass, for drying property and discharge reliability of the porous layer forming material.

Water

Water is a main medium for the porous layer forming material. For reducing ionic impurities as much as possible, pure water such as ion-exchange water, ultrafiltration water, reverse osmosis water, and distilled water, and ultrapure water are preferably used as the medium of the porous layer forming material. In addition, sterile water, sterilized by ultraviolet irradiation or addition of hydrogen peroxide, is preferably used for preventing generation of mold and bacteria during a long-term storage of the porous layer forming material.

Preferably, the content rate of water in the porous layer forming material is in the range of from 10% to 75% by mass, more preferably from 20% to 60% by mass, for reducing environmental load and further including other components in the porous layer forming material.

Resin

Specific examples the resin include, but are not limited to, urethane resins, polyester resins, acrylic resins, vinyl acetate resins, styrene resins, butadiene resins, styrene-butadiene resins, vinyl chloride resins, acrylic styrene resins, and acrylic silicone resins. These resins may be in the form of particles (hereinafter "resin particles"). The resin particles may be dispersed in water serving as a dispersion medium to become a resin emulsion. The porous layer forming material can be obtained by mixing the resin emulsion with other materials such as colorants and organic solvents. These resin particles are available either synthetically or commercially. The resin particles may include one type or two or more types of resin particles.

As the resin, a water-soluble resin is also preferably used. Specific examples of the water-soluble resins include, but are not limited to, proteins (e.g., gelatin, casein), natural rubbers (e.g., gum arabic), glucosides (e.g., saponin), cellulose derivatives (e.g., methyl cellulose, carboxymethyl cellulose, hydroxymethyl cellulose), lignosulfonate, natural polymers (e.g., shellac), polyacrylate, polyacrylamide, salts of styrene-acrylic acid copolymers, salts of vinylnaphthalene-acrylic acid copolymers, salts of styrene-maleic acid copolymers, salts of vinylnaphthalene-maleic acid copolymers, sodium salts of β-naphthalenesulfonic acid formalin condensates, ionic polymers (e.g., polyphosphoric acid), polyvinyl alcohol, polyvinyl butyral, polyethylene glycol, polypropylene glycol, polyethylene oxide, polyvinyl methyl ether, and polyethyleneimine.

The content rate of the resin in the porous layer forming material is preferably in the range of from 0.05% to 10.0% by mass, and more preferably from 0.3% to 4.0% by mass. Within that range, the resin can sufficiently exhibit its function to provide excellent scratch resistance. In addition, preferable metallic luster can be provided, which is preferable.

Surfactant

Usable surfactants include silicone-based surfactants, fluorine-based surfactants, ampholytic surfactants, nonionic surfactants, and anionic surfactants.

The silicone-based surfactants have no specific limit and can be suitably selected to suit to a particular application. Preferred are silicone-based surfactants which are not decomposed even in a high pH environment. Specific examples thereof include, but are not limited to, side-chain-modified polydimethylsiloxane, both-end-modified polydimethylsiloxane, one-end-modified polydimethylsiloxane, and side-chain-both-end-modified polydimethylsiloxane. In particular, those having a polyoxyethylene group and/or a polyoxyethylene polyoxypropylene group as the modifying group are preferable because they demonstrate good characteristics as an aqueous surfactant. Specific examples of the silicone-based surfactants further include polyether-modified silicone-based surfactants, such as a dimethyl siloxane compound having a polyalkylene oxide structure unit on a side chain thereof which is bonded to Si.

Specific preferred examples of the fluorine-based surfactants include, but are not limited to, perfluoroalkyl sulfonic acid compounds, perfluoroalkyl carboxylic acid compounds, perfluoroalkyl phosphate compounds, perfluoroalkyl ethylene oxide adducts, and polyoxyalkylene ether polymer compounds having a perfluoroalkyl ether group on its side chain. These compounds have weak foaming property, which is preferable. Specific examples of the perfluoroalkyl sulfonic acid compounds include, but are not limited to, perfluoroalkyl sulfonic acid and perfluoroalkyl sulfonate. Specific examples of the perfluoroalkyl carboxylic acid compounds include, but are not limited to, perfluoroalkyl carboxylic acid and perfluoroalkyl carboxylate. Specific examples of the polyoxyalkylene ether polymer compounds having a perfluoroalkyl ether group on a side chain include, but are not limited to, a sulfate of a polyoxyalkylene ether polymer having a perfluoroalkyl ether group on its side chain, and a salt of a polyoxyalkylene ether polymer having a perfluoroalkyl ether group on its side chain. Specific examples of the counter ions for these fluorine-based surfactants include, but are not limited to, Li, Na, K, $NH_4$, $NH_3CH_2CH_2OH$, $NH_2(CH_2CH_2OH)_2$, and $NH(CH_2CH_2OH)_3$.

Specific examples of the ampholytic surfactants include, but are not limited to, laurylaminopropionate, lauryl dimethyl betaine, stearyl dimethyl betaine, and lauryl hydroxyethyl betaine.

Specific examples of the nonionic surfactants include, but are not limited to, polyoxyethylene alkyl phenyl ethers, polyoxyethylene alkyl esters, polyoxyethylene alkyl amines, polyoxyethylene alkyl amides, polyoxyethylene propylene block copolymers, sorbitan fatty acid esters, polyoxyethylene sorbitan fatty acid esters, and ethylene oxide adducts of acetylene alcohol.

Specific examples of the anionic surfactants include, but are not limited to, acetate, dodecylbenzene sulfonate, and laurate of polyoxyethylene alkyl ether, and polyoxyethylene alkyl ether sulfate.

Each of these compounds can be used alone or in combination with others.

Specific examples of the silicone-based surfactants include, but are not limited to, side-chain-modified polydimethylsiloxane, both-end-modified polydimethylsiloxane, one-end-modified polydimethylsiloxane, and side-chain-and-both-end-modified polydimethylsiloxane. More specifically, polyether-modified silicone-based surfactants having polyoxyethylene group and/or polyoxyethylene polyoxypropylene group as the modifying groups are preferable since they exhibit good properties as an aqueous surfactant.

These surfactants are available either synthetically or commercially. Commercial products are readily available from, for example, BYK Japan KK, Shin-Etsu Chemical Co., Ltd., Dow Corning Toray Co., Ltd., Nihon Emulsion Co., Ltd., and Kyoeisha Chemical Co., Ltd.

Specific examples of the polyether-modified silicone-based surfactants include, but are not limited to, a compound represented by the following formula (S-1) that is a dimethylpolysiloxane having a polyalkylene oxide structure on its side chain bonded to Si atom.

Formula (S-1)

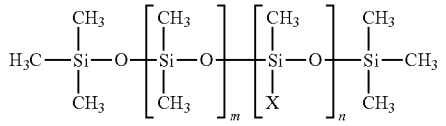

$X = \text{—}R(C_2H_4O)_a(C_3H_6O)_bR'$

In the formula (S-1), each of m, n, a, and b independently represents an integer, R represents an alkylene group, and R' represents an alkyl group. Specific examples of commercially-available polyether-modified silicone-based surfactants include, but are not limited to: KF-618, KF-642, and KF-643 (available from Shin-Etsu Chemical Co., Ltd.); EMALEX-SS-5602 and SS-1906EX (available from Nihon Emulsion Co., Ltd.); FZ-2105, FZ-2118, FZ-2154, FZ-2161, FZ-2162, FZ-2163, and FZ-2164 (available from Dow Coming Toray Co., Ltd); BYK-33 and BYK-387 (available from BYK Japan KK); and TSF4440, TSF4452, and TSF4453 (available from Momentive Performance Materials Inc.).

Preferably, the fluorine-based surfactant is a compound having 2 to 16 fluorine-substituted carbon atoms, more preferably a compound having 4 to 16 fluorine-substituted carbon atoms.

Specific examples of the fluorine-based surfactants include, but are not limited to, perfluoroalkyl phosphate compounds, perfluoroalkyl ethylene oxide adducts, and polyoxyalkylene ether polymer compounds having a perfluoroalkyl ether group on its side chain Among these fluorine-based surfactants, polyoxyalkylene ether polymer compounds having a perfluoroalkyl ether group on its side chain are preferable since foaming property thereof is small. More specifically, compounds represented by the following formula (F-1) and (F-2) are preferable.

$$CF_3CF_2(CF_2CF_2)_m—CH_2CH_2O(CH_2CH_2O)_nH \quad \text{Formula (F-1)}$$

In the formula (F-1), m is preferably an integer in the range of from 0 to 10, and n is preferably an integer in the range of from 0 to 40, to give water-solubility to the compound.

$$C_nF_{2+1}—CH_2CH(OH)CH_2—O—(CH_2CH_2O)_a—Y \quad \text{Formula (F-2)}$$

In the formula (F-2), Y represents H, $C_mF_{2m+1}$ (where m represents an integer of from 1 to 6), $CH_2CH(OH)CH_2—C_mF_{2m+1}$ (where m represents an integer of from 4 to 6), or $C_pF_{2p+1}$ (where p represents an integer of from 1 to 19); n represents an integer of from 1 to 6; and a represents an integer of from 4 to 14.

The fluorine-based surfactants are available either synthetically or commercially. Specific examples of commercially-available fluorine-based surfactants include, but are not limited to: SURFLON S-111, S-112, S-113, S-121, S-131, S-132, S-141, and S-145 (available from Asahi Glass Co., Ltd.); Fluorad™ FC-93, FC-95, FC-98, FC-129, FC-135, FC-170C, FC-430, and FC-431 (available from Sumitomo 3M Limited); MEGAFACE F-470, F-1405, and F-474 (available from DIC Corporation); Zonyl® TBS, FSP, FSA, FSN-100, FSN, FSO-100, FSO, FS-300, UR, CAPSTONE FS-30, FS-31, FS-3100, FS-34, and FS-35 (available from The Chemours Company); FT-110, FT-250, FT-251, FT-400S, FT-150, and FT-400SW (available from NEOS COMPANY LIMITED); PolyFox PF-136A, PF-156A, PF-151N, PF-154, and PF-159 (available from OMNOVA Solutions Inc.); and UNIDYNE™ DSN-403N (available from Daikin Industries, Ltd.). Among these, for improving text quality, in particular color developing property, paper permeability, paper wettability, and uniform dying property, FS-3100, FS-34, and FS-300 (available from The Chemours Company), FT-110, FT-250, FT-251, FT-400S, FT-150, and FT-400SW (available from NEOS COMPANY LIMITED), PolyFox PF-151N (available from OMNOVA Solutions Inc.), and UNIDYNE™ DSN-403N (available from Daikin Industries, Ltd.) are particularly preferred.

Preferably, the content rate of the surfactant in the porous layer forming material is in the range of from 0.001% to 5% by mass, more preferably from 0.05% to 5% by mass, for improving wettability, discharge stability, and image quality.

Defoamer

Specific examples of the defoamer include, but are not limited to, silicone defoamers, polyether defoamers, and fatty acid ester defoamers. Each of these defoamers can be used alone or in combination with others. Among these defoamers, silicone defoamers are preferable since they have excellent defoaming ability.

Preservative and Fungicide

Specific examples of the preservative and fungicide include, but are not limited to, 1,2-benzisothiazoline-3-one.

Corrosion Inhibitor

Specific examples of the corrosion inhibitor include, but are not limited to, acid sulphite and sodium thiosulfate.

pH Adjuster

The pH adjuster has no particular limit so long as it is capable of adjusting the pH to 7 or higher. Specific examples of such a pH adjuster include, but are not limited to, amines such as diethanolamine and triethanolamine.

The properties of the porous layer forming material, such as viscosity, surface tension, and pH, are not particularly limited and can be suitably selected to suit to a particular application.

Preferably, the porous layer forming material has a viscosity at 25° C. in the range of from 5 to 30 mPa·s, more preferably from 5 to 25 mPa·s, for improving print density and text quality and obtaining good dischargeability. The viscosity can be measured at 25° C. by a rotatory viscometer (RE-80L available from Toki Sangyo Co., Ltd.) equipped with a standard cone rotor (1° 34'×R24), while setting the sample liquid amount to 1.2 mL, the number of rotations to 50 rotations per minute (rpm), and the measuring time to 3 minutes.

Preferably, the porous layer forming material has a surface tension of 35 mN/m or less, more preferably 32 mN/m or less, at 25° C., so that the porous layer forming material is suitably levelized on a recording medium and the drying time of the porous layer forming material is shortened.

Preferably, the porous layer forming material has a pH in the range of from 7 to 12, more preferably from 8 to 11, for preventing corrosion of metal materials contacting the porous layer forming material.

Silver Ink Applying Process and Silver Ink Applying Device

The silver ink applying process is a process in which a silver ink is applied to the porous layer having an average pore diameter greater than 200 nm and not greater than 400 nm and an average thickness of from 5 to 30 μm that is formed by applying the porous layer forming material to a recording medium. The silver ink applying process may be performed by the silver ink applying device.

The silver ink applying process may be performed by applying the silver ink to the porous layer by, for example, a bar coater or an inkjet head.

Examples of the silver ink applying device include, but are not limited to, a bar coater and an inkjet head.

It is preferable that the silver ink applying process is performed continuously with the porous layer forming process. In a case in which the silver ink applying process and the porous layer forming process are performed continuously, the silver ink applying process and the porous layer forming process may be performed by either separate apparatuses or the same apparatus. When these processes are performed by the same apparatus, recorded matter with more excellent metallic luster and image clarity can be obtained as the productivity is improved as well as landing of the silver ink on the porous layer can be appropriately controlled.

Ink Containing Silver

The ink containing silver ("silver ink") contains silver, and may optionally contain additives such as a polymer dispersant, an organic solvent, water, a resin, a surfactant, a defoamer, a fungicide, a preservative, a corrosion inhibitor, and a pH adjuster, if needed. The silver ink may be prepared as a silver colloid containing silver, water, and a solvent having a moisturizing function. The above-described additives may be added thereto as necessary. Silver is a metal having a higher degree of whiteness among various metals. Advantageously, silver can express various metallic colors when combined with inks having different colors. Silver is stable in water due to its weak reactivity with water. Therefore, silver can be applied to water-based glittering inks, which contributes to reduction of environmental load.

Examples of the additives such as the above-described organic solvent, water, resin, surfactant, defoamer, fungicide, preservative, and pH adjuster include those exemplified as additives for the porous layer forming material.

The above-described effects of the additives, contents of the additives, and properties of the silver ink can also be obtained in the silver ink as with the porous layer forming material.

Silver

The silver is capable of improving image clarity and metallic luster of the recorded matter. The silver preferably comprises silver particles. Preferably, the silver particles have a number average particle diameter of from 15 to 100 nm, more preferably from 30 to 60 nm. When the number average particle diameter is 15 nm or more, it is prevented that nano particles of the silver enter into the porous layer to be present at the lowermost surface of the recorded matter and that the color tone becomes unnatural due to an adverse affect of the yellow color of the nano silver particles. Thus, metallic luster is well improved. When the number average particle diameter is 100 nm or less, the ink can be reliably discharged without causing precipitation of the silver with time.

The number average particle diameter can be measured by a laser diffraction particle size distribution analyzer. Specific examples of the laser diffraction particle size distribution analyzer include, but are not limited to, those employing a dynamic light scattering method, such as MICROTRACK UPA available from Nikkiso Co., Ltd.

The content rate of the silver in the silver ink is preferably from 1.0% to 15.0% by mass, and more preferably from 2.5% to 10% by mass. When the content rate is 1.0% by mass or more, high image clarity and metallic luster are developed. When the content rate is 15.0% by mass or less, dispersion stability of the silver and storage stability and discharge stability of the silver ink are improved.

Silver Colloid Liquid

Preferably, the silver is dispersed in an aqueous dispersion medium to form silver colloids to the surface of which protection colloids are adhered. In this case, the silver can be well dispersed in the aqueous dispersion medium and storage stability of the silver ink is drastically improved. The silver colloids may be prepared by, for example, reducing silver ions contained in a solution with a reducing agent in the presence of protection colloids, as described in JP-2006-299329-A. In a case in which silver colloids are prepared by such a method, dispersion stability of the silver particles is more improved as a surfactant is added to the solution at any time before and after the reduction reaction. The protection colloids are not limited so long as they comprise an organic matter capable of protecting the surfaces of silver. Specific examples of such organic matter include, but are not limited to, carboxyl-group-containing organic compounds and polymeric dispersants. Each of these materials can be used alone or combination with others. Combinations are more preferable for their synergistic effects.

Carboxyl-Group-Containing Organic Compounds

The number of carboxyl groups in one molecule of the carboxyl-group-containing organic compound is at least one, preferably from 1 to 10, more preferably from 1 to 5, and most preferably from 1 to 3, but is not limited thereto. A part or all of the carboxyl groups in the carboxyl-group-containing organic compound may form a salt (e.g., amine salt, metal salt). In particular, organic compounds in which most carboxyl groups are not forming salts, i.e., organic compounds containing free carboxyl groups, are preferable. More particularly, organic compounds in which all the carboxyl groups are not forming salts (e.g., amine salts) with a basic compound (e.g., amine) are preferable.

The carboxyl-group-containing organic compound may further contain a functional group (including a ligand group for metallic compounds or metallic nano particles) other than carboxyl group.

Examples of the functional group (or ligand group) other than the carboxyl group include, but are not limited to, a group (or functional group) having at least one hetero atom selected from halogen atom, nitrogen atom, oxygen atom, and sulfur atom; and a group forming a salt thereof (e.g., ammonium salt group). Each of these functional groups may be contained in the carboxyl-group-containing organic compound alone or in combination with others.

Examples of the halogen atom include, but are not limited to, fluorine atom, chlorine atom, bromine atom, and iodine atom.

Examples of the group having nitrogen atom include, but are not limited to, amino group, a substituted amino group (e.g., a dialkylamino group), imino group (—NH—), a nitrogen ring group (e.g., a 5- to 8-membered nitrogen ring group such as pyridyl group; carbazole group; and morpholinyl group), amide group (—CON<), cyano group, and nitro group.

Examples of the group having oxygen atom include, but are not limited to, hydroxyl group, an alkoxy group (e.g., an alkoxy group having 1 to 6 carbon atoms such as methoxy group, ethoxy group, propoxy group, and butoxy group), formyl group, carbonyl group (—CO—), ester group (—COO—), an oxygen ring group (e.g., a 5- to 8-membered oxygen ring group such as tetrahydropyranyl group).

Examples of the group having sulfur atom include, but are not limited to, thio group, thiol group, thiocarbonyl group (—SO—), an alkylthio group (e.g., an alkylthio group having 1 to 4 carbon atoms such as methylthio group and ethylthio group), sulfo group, sulfamoyl group, and sulfinyl group ($—SO_2—$).

Among the above functional groups, preferably, basic groups capable of forming a salt with carboxyl group, such as amino group, substituted amino group, imino group, and ammonium salt group, are preferably not contained in the carboxyl-group-containing organic compound.

Examples of the carboxyl-group-containing organic compound include carboxylic acids. Examples of carboxylic acids include, but are not limited to, monocarboxylic acids, polycarboxylic acids, and hydroxycarboxylic acids (or oxycarboxylic acids).

Examples of the monocarboxylic acids include, but are not limited to, saturated aliphatic monocarboxylic acids, unsaturated aliphatic monocarboxylic acids, and aromatic monocarboxylic acids.

Specific examples of the saturated aliphatic monocarboxylic acids include, but are not limited to, aliphatic monocarboxylic acids having 1 to 34 carbon atoms (preferably aliphatic monocarboxylic acids having 1 to 30 carbon atoms) such as acetic acid, propionic acid, butyric acid, caprylic acid, caproic acid, hexanoic acid, capric acid, lauric acid, myristic acid, cyclohexane carboxylic acid, dehydrocholic acid, and cholanic acid.

Specific examples of the unsaturated aliphatic monocarboxylic acids include, but are not limited to, unsaturated aliphatic monocarboxylic acids having 4 to 34 carbon atoms (preferably unsaturated aliphatic monocarboxylic acids having 10 to 30 carbon atoms) such as oleic acid, erucic acid, linoleic acid, and abietic acid.

Specific examples of the aromatic monocarboxylic acids include, but are not limited to, aromatic monocarboxylic acids having 7 to 12 carbon atoms such as benzoic acid and naphthoic acid.

Examples of the polycarboxylic acids include, but are not limited to, aliphatic saturated polycarboxylic acids, aliphatic unsaturated polycarboxylic acids, and aromatic polycarboxylic acids.

Specific examples of the aliphatic saturated polycarboxylic acids include, but are not limited to, aliphatic saturated polycarboxylic acids having 2 to 14 carbon atoms (preferably aliphatic saturated polycarboxylic acids having 2 to 10 carbon atoms) such as oxalic acid, malonic acid, succinic acid, glutaric acid, adipic acid, azelaic acid, sebacic acid, and cyclohexanedicarboxylic acid.

Specific examples of the aliphatic unsaturated polycarboxylic acids include, but are not limited to, aliphatic unsaturated polycarboxylic acids having 4 to 14 carbon atoms (preferably unsaturated polycarboxylic acids having 4 to 10 carbon atoms) such as maleic acid, fumaric acid, itaconic acid, sorbic acid, and tetrahydrophthalic acid.

Specific examples of the aromatic polycarboxylic acids include, but are not limited to, aromatic polycarboxylic acids having 8 to 12 carbon atoms such as phthalic acid and trimellitic acid.

Examples of the hydroxycarboxylic acids include, but are not limited to, hydroxymonocarboxylic acids and hydroxypolycarboxylic acids.

Examples of the hydroxymonocarboxylic acids include, but are not limited to, aliphatic hydroxymonocarboxylic acids and aromatic hydroxymonocarboxylic acids.

Specific examples of the aliphatic hydroxymonocarboxylic acids include, but are not limited to, aliphatic hydroxymonocarboxylic acids having 2 to 50 carbon atoms (preferably aliphatic hydroxymonocarboxylic acids having 2 to 34 carbon atoms, more preferably aliphatic hydroxymonocarboxylic acids having 2 to 30 carbon atoms) such as glycolic acid, lactic acid, oxybutyric acid, glyceric acid, 6-hydroxyhexanoic acid, cholic acid, deoxycholic acid, chenodeoxycholic acid, 12-oxochenodeoxycholic acid, glycocholic acid, lithocolic acid, hyodeoxycholic acid, ursodeoxycholic acid, apocholic acid, and taurocholic acid.

Specific examples of the aromatic hydroxymonocarboxylic acids include, but are not limited to, aromatic hydroxymonocarboxylic acids having 7 to 12 carbon atoms such as salicylic acid, oxybenzoic acid, and gallic acid.

Examples of the hydroxypolycarboxylic acids include, but are not limited to, aliphatic hydroxypolycarboxylic acids.

Specific examples of the aliphatic hydroxypolycarboxylic acids include, but are not limited to, aliphatic hydroxypolycarboxylic acids having 2 to 10 carbon atoms such as tartronic acid, tartaric acid, citric acid, and malic acid.

The above carboxylic acids may form a salt, anhydride, or hydrate. In many cases, the carboxylic acids are not forming a salt (in particular a salt with a basic compound, such as an amine salt).

Each of the above carboxyl-group-containing organic compounds can be used alone or in combination with others.

Among the above carboxyl-group-containing organic compounds, hydroxycarboxylic acids such as aliphatic hydroxycarboxylic acids (e.g., aliphatic hydroxymonocarboxylic acids, aliphatic hydroxypolycarboxylic acids) are preferable.

Among the aliphatic hydroxycarboxylic acids, alicyclic hydroxycarboxylic acids (i.e., hydroxycarboxylic acids having an alicyclic backbone) are preferable.

Among the alicyclic hydroxycarboxylic acids (i.e., hydroxycarboxylic acids having an alicyclic backbone), alicyclic hydroxycarboxylic acids having 6 to 34 carbon atoms, such as cholic acid, are preferable; alicyclic hydroxycarboxylic acids having 10 to 34 carbon atoms are more preferable; and alicyclic hydroxycarboxylic acids having 16 to 30 carbon atoms are most preferable.

In addition, polycyclic aliphatic hydroxycarboxylic acids, such as cholic acid, and polycyclic aliphatic carboxylic acids, such as dehydrocholic acid and cholanic acid, are preferable since they exert a large effect of suppressing aggregation of silver particles due to their bulky structures.

Examples of the polycyclic aliphatic hydroxycarboxylic acids include, but are not limited to, condensed polycyclic aliphatic hydroxycarboxylic acids, preferably condensed polycyclic aliphatic hydroxycarboxylic acids having 10 to 34 carbon atoms, more preferably condensed polycyclic aliphatic hydroxycarboxylic acids having 14 to 34 carbon atoms, and particularly preferably condensed polycyclic aliphatic hydroxycarboxylic acids having 18 to 30 carbon atoms.

Examples of the polycyclic aliphatic carboxylic acids include, but are not limited to, condensed polycyclic aliphatic carboxylic acids, preferably condensed polycyclic aliphatic carboxylic acids having 10 to 34 carbon atoms, more preferably condensed polycyclic aliphatic carboxylic acids having 14 to 34 carbon atoms, and particularly preferably condensed polycyclic aliphatic carboxylic acids having 18 to 30 carbon atoms.

Preferably, the carboxyl-group-containing organic compound has a number average molecular weight of 1,000 or less, more preferably 800 or less, and most preferably 600 or less. Preferably, the carboxyl-group-containing organic compound has a pKa value of 1 or more, more preferably 2 or more, and most preferably from 2 to 8. The number average molecular weight can be measured by gel permeation chromatography (GPC).

Polymeric Dispersant

In accordance with some embodiments of the present invention, the protection colloids may comprise a combination of the carboxyl-group-containing organic compound and a polymeric dispersant. In a case in which the protection colloids comprise such a combination, the silver colloids contain a remarkably small number of coarse silver particles. In particular, by use of a specific combination of the carboxyl-group-containing organic compound and a polymeric dispersant as the protection colloids, the proportion of silver in the silver colloids can be increased even though the amount of coarse silver particles is small, thereby improving storage stability of the silver colloids (and a liquid dispersion thereof).

Examples of the polymer dispersant include, but are not limited to, styrene resins, acrylic resins, water-soluble urethane resins, water-soluble acrylic urethane resins, water-soluble epoxy resins, water-soluble polyester resins, cellulose derivatives, polyvinyl alcohols, polyalkylene glycols, natural polymers, polyethylene sulfonates, and formalin condensates of naphthalene sulfonic acid. Each of the above polymeric dispersants may be used alone or in combination with others.

Specific examples of the styrene resins include, but are not limited to, styrene-(meth)acrylic acid copolymers and styrene-maleic anhydride copolymers.

Specific examples of the acrylic resins include, but are not limited to, methyl (meth)acrylate-(meth)acrylic acid copolymers.

Specific examples of the cellulose derivatives include, but are not limited to: nitrocellulose; alkyl celluloses such as ethyl cellulose; alkyl hydroxyalkyl celluloses such as ethyl hydroxyethyl cellulose; hydroxyalkyl celluloses such as hydroxyethyl cellulose and hydroxypropyl cellulose; and cellulose esters such as carboxyalkyl celluloses such as carboxymethyl cellulose.

Specific examples of the polyalkylene glycols include, but are not limited to, gelatin and dextrin.

Specific examples of the polyalkylene glycols include, but are not limited to, polyethylene glycol and polypropylene glycol in a liquid state.

Representative examples of the polymeric dispersant (i.e., amphiphilic polymeric dispersants) include resins (or water-soluble resins and water-dispersible resins) containing a hydrophilic unit (or hydrophilic block) comprising a hydrophilic monomer.

Examples of the hydrophilic monomer include, but are not limited to: addition polymerizable monomers such as carboxyl-group-containing or acid-anhydride-group-containing monomers and hydroxyl-group-containing monomers; and condensation polymerizable monomers such as alkylene oxides (e.g., ethylene oxide).

Specific examples of the acid-anhydride-group-containing monomers include, but are not limited to: (meth)acrylic monomers such as acrylic acid and methacrylic acid; unsaturated polycarboxylic acids such as maleic acid; and maleic anhydride.

Specific examples of the hydroxyl-group-containing monomers include, but are not limited to: hydroxyalkyl (meth)acrylates such as 2-hydroxyethyl (meth)acrylate; and vinylphenol.

The condensation polymerizable monomers may form a hydrophilic unit through a reaction with an active group such as hydroxyl group (e.g., the hydroxyl-group-containing monomer).

Each of the above hydrophilic monomers may form a hydrophilic unit alone or in combination with others.

The polymeric dispersant includes at least a hydrophilic unit (or hydrophilic block). The polymeric dispersant may comprise either a homopolymer or copolymer of the above hydrophilic monomers (e.g., polyacrylic acid and a salt thereof). Alternatively, the polymeric dispersant may comprise a copolymer of a hydrophilic monomer and a hydrophobic monomer, such as the above-exemplified styrene resins and acrylic resins.

Specific examples of the hydrophobic monomers (non-ionic monomers) include, but are not limited to: (meth) acrylic monomers such as (meth)acrylic acid esters; styrene monomers such as styrene, α-methylstyrene, and vinyltoluene; olefin monomers having 2 to 20 α-caron atoms; and carboxylic acid vinyl ester monomers such as vinyl acetate and vinyl butyrate. Each of these hydrophobic monomers may form a hydrophobic unit alone or in combination with others.

Specific examples of the (meth)acrylic acid esters include, but are not limited to: C1-C20 alkyl (meth)acrylates such as methyl (meth)acrylate, ethyl (meth)acrylate, n-butyl (meth) acrylate, 2-ethylhexyl (meth)acrylate, lauryl (meth)acrylate, and stearyl (meth)acrylate; cycloalkyl (meth)acrylates such as cyclohexyl (meth)acrylate; aryl (meth)acrylates such as phenyl (meth)acrylate; and aralkyl (meth)acrylates such as benzyl (meth)acrylate and 2-phenylethyl (meth)acrylate.

Specific examples of the olefin monomers having 2 to 20 α-caron atoms include, but are not limited to, ethylene, propylene, 1-butene, isobutylene, 1-hexene, 1-octene, and 1-dodecene.

In a case in which the polymeric dispersant comprises a copolymer (e.g., a copolymer of a hydrophilic monomer and a hydrophobic monomer), the copolymer may be any of a random copolymer, an alternating copolymer, a block copolymer (e.g., a copolymer comprising a hydrophilic block comprising a hydrophilic monomer and a hydrophobic block comprising a hydrophobic monomer), and a comb-like copolymer (or a comb-like graft copolymer).

The block copolymer may take a diblock structure or a triblock structure (e.g., ABA type, BAB type). With respect to the comb-like copolymer, the main chain thereof may comprise any of the hydrophilic block, the hydrophobic block, and both of the hydrophilic block and the hydrophobic block.

The hydrophilic unit may comprise a condensed block, such as a hydrophilic block comprising an alkylene oxide (e.g., ethylene oxide), such as a polyalkylene oxide (e.g., polyethylene oxide, polyethylene oxide-polypropylene oxide).

The hydrophilic block (e.g., polyalkylene oxide) and the hydrophobic block (e.g., polyolefin block) may be bound to each other via a linking group such as ester bond, amide bond, ether bond, and urethane bond.

Such a bond may be formed by modifying the hydrophobic block (e.g., polyolefin) with a modifying agent and introducing the hydrophilic block thereto.

Specific examples of the modifying agent include, but are not limited to, unsaturated carboxylic acids and anhydrides thereof (e.g., maleic acid and maleic anhydride), lactam or aminocarboxylic acid, hydroxylamine, and diamine.

The comb-like copolymer (the main chain of which comprising the hydrophobic block) may be formed by reacting (or binding) a polymer obtained from a monomer containing a hydrophilic group such as hydroxyl group and carboxyl group (e.g., a hydroxyalkyl (meth)acrylate) with the above-described condensation polymerizable hydrophilic monomer (e.g., ethylene oxide).

In addition, a hydrophilic non-ionic monomer can be copolymerized together for balancing hydrophilicity and hydrophobicity.

Specific examples of such copolymerizable components include, but are not limited to, monomers and oligomers comprising an alkyleneoxy unit (preferably ethyleneoxy unit), such as 2-(2-methoxyethoxy)ethyl (meth)acrylate and polyethylene glycol monomethacrylate (having a number average molecular weight of about 200 to 1,000).

Alternatively, the balance between hydrophilicity and hydrophobicity may be adjusted by modifying (e.g., esterifying) the hydrophilic group (e.g., carboxyl group).

The polymeric dispersant may contain a functional group. Specific examples of the functional group include, but are not limited to, acid groups (e.g., acidic groups such as carboxyl group and acid anhydride group thereof, and sulfo groups such as sulfonic acid group) and hydroxyl group. Each of these functional groups may be contained in the polymeric dispersant alone or in combination with others.

In particular, the polymeric dispersant preferably contains an acid group, more preferably carboxyl group.

In a case in which the polymeric dispersant contains acid groups (e.g., carboxyl groups), a part or all of the acid groups (e.g., carboxyl groups) may form a salt (e.g., amine salt, metal salt). In particular, polymeric dispersants in which most acid groups (e.g., carboxyl groups) are not forming salts, i.e., polymeric dispersants containing free acid groups (e.g. carboxyl groups), are preferable. More particularly, polymeric dispersants in which all the acid groups (e.g., carboxyl groups) are not forming salts (e.g., amine salts) with a basic compound (e.g., amine) are preferable.

Preferably, the polymeric dispersant having an acid group (preferably carboxyl group) has an acid value of from 1 to 100 mgKOH/g, more preferably from 3 to 90 mgKOH/g, much more preferably from 5 to 80 mgKOH/g, and most preferably from 7 to 70 mgKOH/g. The polymeric dispersant having an acid group may have an amine value of 0 mgKOH/g (or substantially 0 mgKOH/g).

The positions of the functional groups in the polymeric dispersant are not limited. The functional groups may be present either in the main chain, a side chain, or both the main chain and a side chain of the polymeric dispersant.

The functional group may be of a functional group derived from a hydrophilic monomer or hydrophilic unit, such as hydroxyl group. The functional group may be introduced to the polymer by copolymerizing a copolymerizable monomer having the functional group, such as maleic anhydride.

Each of the above polymeric dispersants may be used alone or in combination with others.

Specific examples of the polymeric dispersant further include a polymeric pigment dispersant described in JP-2004-207558-A.

The polymeric dispersant is either commercially or synthetically available.

Specific examples of commercially-available polymeric dispersants (including amphiphilic dispersants) include, but are not limited to: SOLSPERSE series, such as SOLSPERSE 13240, SOLSPERSE 13940, SOLSPERSE 32550, SOLSPERSE 31845, SOLSPERSE 24000, SOLSPERSE 26000, SOLSPERSE 27000, SOLSPERSE 28000, and SOLSPERSE 41090, products of AVECIA GROUP; DISPERBYK series, such as DISPERBYK 160, DISPERBYK 161, DISPERBYK162, DISPERBYK 163, DISPERBYK 164, DISPERBYK 166, DISPERBYK 170, DISPERBYK 180, DISPERBYK 182, DISPERBYK 184, DISPERBYK 190, DISPERBYK 191, DISPERBYK 192, DISPERBYK 193, DISPERBYK 194, DISPERBYK 2001, and DISPERBYK 2050, products of BYK Japan KK; EFKA-46, EFKA-47, EFKA-48, EFKA-49, EFKA-1501, EFKA-1502, EFKA-4540, EFKA-4550, POLYMER 100, POLYMER 120, POLYMER 150, POLYMER 400, POLYMER 401, POLYMER 402, POLYMER 403, POLYMER 450, POLYMER 451, POLYMER 452, and POLYMER 453, products of BASF (formerly EFKA Chemicals); AJISPER series, such as AJISPER PB711, AJISPER PA111, AJISPER PB811, AJISPER PB821, and AJISPER PW911, products of Ajinomoto Co., Inc.; FLOWLEN series, such as FLOWLEN DOPA-158, FLOWLEN DOPA-22, FLOWLEN DOPA-17, FLOWLEN TG-700, FLOWLEN TG-720W, FLOWLEN-730W, FLOWLEN-740W, and FLOWLEN-745W, products of Kyoeisha Chemical Co., Ltd.; and Joncryl® series, such as Joncryl® 678, Joncryl® 679, and Joncryl® 62, products of BASF (formerly Johnson Polymer).

Among these polymeric dispersants, DISPERBYK 190 and DISPERBYK 194 each have an acid group.

Preferably, the number average molecular weight of the polymer dispersant is from 1,500 to 100,000, more preferably 2,000 to 80,000, much more preferably from 3,000 to 50,000, and particularly preferably from 7, 000 to 20,000.

In recent years, silver colloid liquids are commercially available from a lot of manufacturers and are applicable to inks by the ink preparation method described above.

Color Ink Applying Process and Color Ink Applying Device

The color ink applying process is a process in which a color ink containing a colorant is applied to the porous layer or a layer containing silver. The color ink applying process is performed by a color ink applying device.

The color ink applying process may be performed by applying the color ink to the recording medium by, for example, a bar coater or an inkjet head.

Examples of the color ink applying device include, but are not limited to, a bar coater and an inkjet head.

Color Ink

The color ink contains a colorant other than silver, and may optionally contain a solvent, a resin, a surfactant, a defoamer, a fungicide, a preservative, a corrosion inhibitor, and/or a pH adjuster, if needed.

The color ink containing a colorant other than silver is clearly distinguished from the silver ink containing silver. Examples of the color ink include, but are not limited to, achromatic color inks such as black ink and white ink, and chromatic color inks such as yellow ink, magenta ink, and cyan ink.

As the color ink is applied, various metallic colors other than silver can be reproduced.

Examples of the solvent include, but are not limited to, organic solvents and water.

Examples of the additives such as the above-described organic solvent, water, resin, surfactant, defoamer, fungicide, preservative, and pH adjuster include those exemplified as additives for the porous layer forming material.

The above-described effects of the additives, contents of the additives, and physical properties of the color ink can also be obtained in the color ink as with the porous layer forming material.

Colorant

Examples of the colorant include, but are not limited to, pigments and dyes.

Usable pigments include both inorganic pigments and organic pigments. Each of these pigments can be used alone or in combination with others. Mixed crystals can also be used as the colorant.

Usable pigments include black pigments, yellow pigments, magenta pigments, cyan pigments, white pigments, green pigments, orange pigments, glossy color pigments (e.g., gold pigments and silver pigments), and metallic pigments.

Specific examples of inorganic pigments include, but are not limited to, titanium oxide, iron oxide, calcium carbonate, barium sulfate, aluminum hydroxide, barium yellow, cadmium red, chrome yellow, and carbon black produced by a known method, such as a contact method, a furnace method, and a thermal method.

Specific examples of organic pigments include, but are not limited to, azo pigments, polycyclic pigments (e.g., phthalocyanine pigments, perylene pigments, perinone pigments, anthraquinone pigments, quinacridone pigments, dioxazine pigments, indigo pigments, thioindigo pigments, isoindolinone pigments, and quinophthalone pigments), dye chelates (e.g., basic dye chelate, acid dye chelate), nitro pigments, nitroso pigments, and aniline black. Among these pigments, those having good affinity for solvents are preferable. In addition, resin hollow particles and inorganic hollow particles can also be used.

Specific examples of pigments used for black-and-white printing include, but are not limited to: carbon blacks (i.e., C.I. Pigment Black 7) such as furnace black, lamp black, acetylene black, and channel black; metals such as copper, iron (i.e., C.I. Pigment Black 11), and titanium oxide; and organic pigments such as aniline black (i.e., C.I. Pigment Black 1).

Specific examples of pigments used for color printing include, but are not limited to: C.I. Pigment Yellow 1, 3, 12, 13, 14, 17, 24, 34, 35, 37, 42 (yellow iron oxide), 53, 55, 74, 81, 83, 95, 97, 98, 100, 101, 104, 108, 109, 110, 117, 120, 138, 150, 153, 155, 180, 185, and 213; C.I. Pigment Orange 5, 13, 16, 17, 36, 43, and 51; C.I. Pigment Red 1, 2, 3, 5, 17, 22, 23, 31, 38, 48:2 (Permanent Red 2B(Ca)), 48:3, 48:4, 49:1, 52:2, 53:1, 57:1 (Brilliant Carmine 6B), 60:1, 63:1, 63:2, 64:1, 81, 83, 88, 101 (red iron oxide), 104, 105, 106, 108 (cadmium red), 112, 114, 122 (quinacridone magenta), 123, 146, 149, 166, 168, 170, 172, 177, 178, 179, 184, 185, 190, 193, 202, 207, 208, 209, 213, 219, 224, 254, and 264; C.I. Pigment Violet 1 (rhodamine lake), 3, 5:1, 16, 19, 23, and 38; C.I. Pigment Blue 1, 2, 15 (phthalocyanine blue), 15:1, 15:2, 15:3, 15:4 (phthalocyanine blue), 16, 17:1, 56, 60, and 63; and C.I. Pigment Green 1, 4, 7, 8, 10, 17, 18, and 36.

Usable dyes include acid dyes, direct dyes, reactive dyes, and basic dyes. Two or more of these dyes can be used in combination.

Specific examples of the dye include, but are not limited to, C.I. Acid Yellow 17, 23, 42, 44, 79, and 142, C.I. Acid Red 52, 80, 82, 249, 254, and 289, C.I. Acid Blue 9, 45, and 249, C.I. Acid Black 1, 2, 24, and 94, C. I. Food Black 1 and 2, C.I. Direct Yellow 1, 12, 24, 33, 50, 55, 58, 86, 132, 142, 144, and 173, C.I. Direct Red 1, 4, 9, 80, 81, 225, and 227, C.I. Direct Blue 1, 2, 15, 71, 86, 87, 98, 165, 199, and 202, C.I. Direct Black 19, 38, 51, 71, 154, 168, 171, and 195, C.I. Reactive Red 14, 32, 55, 79, and 249, and C.I. Reactive Black 3, 4, and 35.

Preferably, the content rate of the colorant in the ink is in the range of from 0.1% to 15% by mass, more preferably from 1% to 10% by mass, for improving image density, fixing strength, and discharge stability.

The pigment can be dispersed in the ink by any of the following methods: introducing a hydrophilic functional group to the pigment to make the pigment self-dispersible; covering the surface of the pigment with a resin; and dispersing the pigment by a dispersant.

In the method of introducing a hydrophilic functional group to the pigment to make the pigment self-dispersible, for example, a functional group such as sulfone group and carboxyl group may be introduced to the pigment (e.g., carbon) to make the pigment dispersible in water.

In the method of covering the surface of the pigment with a resin, for example, the pigment may be incorporated in a microcapsule to make the pigment self-dispersible in water. In this case, the pigment may be referred to as a resin-covered pigment. In this case, not all the pigment particles included in the ink should be covered with a resin. It is possible that a part of the pigment particles is not covered with any resin or partially covered with a resin.

In the method of dispersing the pigment by a dispersant, low-molecular dispersants and high-molecular dispersants, represented by known surfactants, may be used.

More specifically, any of anionic surfactants, cationic surfactants, ampholytic surfactants, and nonionic surfactants may be used as the dispersant depending on the property of the pigment.

For example, a nonionic surfactant RT-100 (product of Takemoto Oil & Fat Co., Ltd.) and sodium naphthalene-sulfonate formalin condensate are preferably used as the dispersant.

Each of the above dispersants may be used alone or in combination with others.

Pigment Dispersion

The ink can be obtained by mixing the pigment with other materials such as water and the organic solvent. The ink can also be obtained by, first, preparing a pigment dispersion by mixing the pigment with water, a pigment dispersant, etc., and thereafter mixing the pigment dispersion with other materials such as water and the organic solvent.

The pigment dispersion can be obtained by mixing water, the pigment, a pigment dispersant, and other components, if any. The pigment is dispersed in the pigment dispersion with the adjusted particle diameter. Preferably, the pigment dispersion is prepared with a disperser.

Preferably, the pigment dispersed in the pigment dispersion has a maximum frequency particle diameter in the range of from 20 to 500 nm, more preferably from 20 to 150 nm, based on the number of pigment particles, for improving dispersion stability of the pigment and discharge stability and image quality (e.g., image density) of the ink. The particle diameter of the pigment can be measured with a particle size distribution analyzer (NANOTRAC WAVE-UT151 available from MicrotracBEL Corp.).

Preferably, the content rate of the pigment in the pigment dispersion is in the range of from 0.1% to 50% by mass, more preferably from 0.1% to 30% by mass, for improving discharge stability and image density.

Preferably, the pigment dispersion may be subjected to filtration using a filter or a centrifugal separator to remove coarse particles, and thereafter to degassing.

Print Layer Containing Silver

A print layer containing silver ("silver-containing print layer") contains silver as a main component. The water, solvent, amines, and dispersing agent contained in the silver ink may remain in the silver-containing print layer. Further, it is preferable that the silver-containing print layer contains a resin, so that scratch resistance and metallic luster of the recorded matter are improved.

The content rate of the resin in the silver-containing print layer is preferably in the range of from 0.2% to 50.0% by mass, and more preferably from 1.0% to 10.0% by mass. When the content rate is from 0.2% to 50.0% by mass, the resin can sufficiently exhibit its function to provide excellent scratch resistance and metallic luster.

The silver-containing print layer is preferably formed on the porous layer having an average pore diameter of greater than 200 nm and not greater than 400 nm and an average thickness of from 5 to 30 μm according to an embodiment of the present invention.

Layer Thickness of Silver-containing Print Layer

The layer thickness of the silver-containing print layer refers to an average layer thickness measured after the layer has been dried. The layer thickness of the silver-containing print layer is preferably in the range of from 50 to 300 nm, so that recorded matter having excellent metallic luster and image clarity can be obtained. In the present disclosure, a print surface refers to a surface of a print layer. When the layer thickness is from 50 to 300 nm, brown color tone derived from plasmon absorption as metal particles is low, and metallic luster and image clarity are improved. In addition, it becomes possible for the porous layer to immediately absorb the vehicle of the ink containing silver, and the metallic luster and the image clarity are improved. The layer thickness needs to be equal to or greater than the particle diameter of one silver particle, since metal-like image clarity is intrinsically exhibited as an interaction between adjacent silver particles arranged in the horizontal direction is increased. In addition, within a range equal to or less than the particle diameter of eight silver particles, it becomes possible for the porous layer to immediately absorb or adsorb the vehicle of the ink containing silver, and the metallic luster and the image clarity are improved.

Image Clarity (2 mm) According to JIS H8686-2

In the present disclosure, an "image clarity value" refers to an image clarity value C measured by a method according to JIS (Japanese Industrial Standards) H8686-2. In the method, an image clarity measuring instrument composed of an optical device and a measuring device is used to measure the image clarity value C. The optical device detects, through a moving optical comb, reflected light (at a light receiving angle of 45 degrees) from a measurement target surface to which light has been directed through a slit at an incident angle of 45 degrees. The measuring device memorizes the detected light quantity as waveform. The image clarity value C can be determined from the following formula based on the varying waveform of the light quantity detected through the optical comb.

$$C(n)=(M-m)/(M+m)\times 100$$

In the formula, C(n) represents an image clarity value (%), M represents a maximum wave height, and m represent a minimum wave height, when the optical comb width is n (nm).

In the present disclosure, an image clarity meter ICM-1 (available from Suga Test Instruments Co., Ltd.) is used as the image clarity measuring instrument, and the optical comb width is set to 2.0 mm.

To obtain a high-image-clarity print surface that is able to reflect a facing object, the image clarity (2 mm) value is preferably 5 or greater, and more preferably 30 or greater. The upper limit of the image clarity value is 98, since the image clarity value of a specular surface capable of reflecting a real image is at most 98.

b* Value

For securing a silver-color print surface having high image clarity, the b* value is preferably in the range of from −7 to +4. As the b* value becomes more minus, bluish color becomes stronger. As the b* value becomes more plus, yellowish color becomes stronger. As yellowish color becomes stronger, the color of the ink containing silver approaches gold color. When the b* value exceeds +4, gold color strongly appears and the color tone becomes far from silver color. When the b* value falls below −7, bluish color becomes stronger and the color tone becomes darker different from silver color. The b* value can be easily measured with a spectrophotometer.

Print Layer Containing Colorant Other Than Silver

The average thickness of a print layer containing a colorant other than silver (i.e., a print layer of the color ink) is preferably from 1 to 300 nm, and more preferably from 2 to 250 nm. In particular, when toning with silver color, the average thickness is particularly preferably from 3 to 100 nm so as not to conceal the silver color. By toning within this range, a colored metallic image can be obtained and a print surface with good texture both in image clarity and color tone can be obtained. It is preferable that toning is performed by printing with the silver ink first and subsequently printing with the color ink on a part which has been printed with the silver ink.

Measurement of Layer Thickness of Print Layer

The layer thickness of the silver-containing print layer or the print layer containing a colorant other than silver can be measured by cutting the printed matter and observing a cross-section thereof with a microscope, such as optical microscope, laser microscope, scanning electron microscope (SEM), and transmission electron microscope (TEM).

Recording Medium

The recording medium is not particularly limited as long as a porous layer having an average pore diameter of greater than 200 nm and not greater than 400 nm and an average thickness of from 5 to 30 μm can be formed on a surface thereof. Examples of the recording medium include, but are not limited to, plain paper, glossy paper, special paper, and cloth. In addition, impermeable substrates may be used for good image formation. A receiving layer (e.g., porous layer) may or may not be formed in advance on the surface of the recording medium.

In particular, according to embodiments of the the present invention, an image having excellent image clarity and metallic luster can be formed even on such an impermeable substrate having no ink receiving layer (e.g., porous layer), providing compatibility for a wide variety of recording media.

The impermeable substrate has a surface with a low level of moisture permeability and absorptivity. Examples of such an impermeable substrate include a material having a number of hollow spaces inside but not open to the exterior. To be more quantitative, the impermeable substrate refers to a substrate that absorbs water in an amount of 10 $mL/m^2$ or less from the start of contact to 30 $msec^{1/2}$ after the start of contact, when measured according to the Bristow method.

Specific preferred examples of the impermeable substrate include, but are not limited to, plastic films such as vinyl chloride resin films, polyethylene terephthalate (PET) films, polypropylene films, polyethylene films, and polycarbonate films. The effect of the present invention is remarkably exerted with these plastic films, because they are generally not porous on the surface so that gloss and image clarity of the silver ink are difficult to obtain.

The recording medium is not limited to articles used as typical recording media. It is suitable to use building materials such as wall paper, floor material, and tile, cloth for apparel such as T-shirts, textile, and leather as the recording medium. In addition, the configuration of the paths through which the recording medium is transferred can be adjusted to accommodate ceramics, glass, metal, etc.

Commercially available recording media having porous properties in advance can also be used as the recording medium. Specific examples of such commercially-available recording media include, but are not limited to; IJ FILM RM-1GP01 (having an average pore diameter of 230 nm) available from Ricoh Co., Ltd.; NB-WF-3GF100 (having an average pore diameter of 210 nm) and NB-RC-3GR120 (having an average pore diameter of 250 nm), available from Mitsubishi Paper Mills Limited; PT-201A420 (having an average pore diameter of 270 nm), SD-101A450 (having an average pore diameter of 250 nm), GL-101A450 (having an average pore diameter of 240 nm), GP501A450 (having an average pore diameter of 250 nm), SP-101A450 (having an average pore diameter of 210 nm), PT-101A420 (having an average pore diameter of 240 nm), and PR101 (having an average pore diameter of 270 nm), available from Canon Inc.; EJK-QTNA450 (having an average pore diameter of 200 nm), EJK-EPNA450 (having an average pore diameter of 210 nm), EJK-CPNA450 (having an average pore diameter of 220 nm), EJK-RCA450 (having an average pore diameter of 240 nm), EJK-OGNA450 (having an average pore diameter of 190 nm), EJK-GANA450 (having an average pore diameter of 180 nm), EJK-NANA450 (having an average pore diameter of 170 nm), and EJK-EGNA450 (having an average pore diameter of 200 nm), available from ELECOM CO., LTD.; WPA455VA (having an average pore diameter of 200 nm), WPA450PRM (having an average pore diameter of 210 nm), G3A450A (having an average pore diameter of 220 nm), G3A450A (having an average pore diameter of 210 nm), and WPA420HIC (having an average pore diameter of 280 nm), available from FUJIFILM Corporation; KA420SCKR (having an average pore diameter of 240 nm), KA450PSKR (having an average pore diameter of 230 nm), and KA450SLU (having an average pore diameter of 210 nm), available from SEIKO EPSON CORPORATION; and BP71GAA4 (having an average pore diameter of 220 nm) available from Brother Industries, Ltd.

Scratch Resistance of Ink Containing Silver

By providing a transparent resin layer on an image formed of the silver-containing print layer formed by applying the ink containing silver to a recording medium, scratch resistance can be improved.

The transparent resin layer may also be provided on a print layer formed by applying the color ink containing a colorant other than silver on the silver-containing print layer formed by applying the ink containing silver to the recording medium.

Laminate Layer Forming Process and Laminate Layer Forming Device

The laminate layer forming process is a process in which a laminate layer is further formed on a region to which the silver ink has been applied in the silver ink applying process. The laminate layer forming process is performed by a laminate layer forming device.

The laminate layer (hereinafter also may be referred to as "resin layer") formed on the print layer comprises a resin. Preferably, the resin is highly transparent. Specific examples of such a resin include, but are not limited to, polyethylene terephthalate (PET) and polypropylene (PP). In addition, nylon may also be used as the resin. The surface of the print layer or the printed matter as a whole is preferably covered with such a resin by a lamination treatment. Alternatively, an overcoat treatment is also preferred in which a water solution or solvent solution of a transparent resin is applied thereto.

The laminate layer forming process can be formed by, for example, blade coating, gravure coating, bar coating, roll coating, dip coating, curtain coating, slide coating, die coating, or spray coating.

Examples of the laminate layer forming device include, but are not limited to, a bar coater and a pressure bonding roller.

The average thickness of the resin layer formed on the print layer is preferably 5 to 300 μm. When the average thickness of the resin layer is less than 5 μm, scratch resistance and durability of the resin layer as the coating film are not sufficient, and a risk of not achieving coating effect is increased so that scratches easily occur and the coating film easily breaks. When the average thickness of the resin layer exceeds 300 μm, not only the high image clarity lowers but also the b* value exceeds 4, resulting in strong yellowish or reddish color tone.

It is preferable that the laminate layer is formed by coating the printed part of the printed matter or the entire printed matter with a resin film, and heat it or coat it by pressure bonding without applying heat. It is more preferable that the print surface or the entire printed matter is coated by a lamination treatment.

Alternatively, an overcoat treatment is also preferred in which a water solution or solvent solution of a transparent resin is applied thereto in place of the lamination treatment.

Recorded Matter

The recorded matter according to an embodiment of the present invention comprises a recording medium, a porous layer on the recording medium, and silver on the porous layer. The average pore diameter of the porous layer is greater than 200 nm and not greater than 400 nm, and the porous average thickness of the porous layer is from 5 to 30 μm. It is preferable that the recorded matter has multiple droplet marks that are porous when observed with a scanning electron microscope from the image-formed-surface side. It is also preferable that the recording medium is an impermeable substrate. Furthermore, the recorded matter has a pigment other than silver on the porous layer.

The recorded matter may be obtained by forming an image by an inkjet image forming apparatus and an inkjet image forming method.

Droplet Marks

When the porous layer is formed by an inkjet method, multiple droplet marks formed by ink droplets are observed in the porous layer. Therefore, the porous layer can be clearly distinguished from a coating layer, if any, on the recording medium.

The droplet mark refers to an indentation formed by a droplet discharged from an inkjet head. The droplet mark may be in a circular shape of a droplet or a shape formed by overlapping of droplets. In a case in which a droplet mark is formed by overlapping of droplets, the droplet mark will be a coalesced droplet mark having a rounded end as illustrated in FIG. 3. This is clearly distinguished from a uniform surface formed with a bar coater or the like.

It is to be noted that droplet marks are observed not only when the porous layer forming material is applied to a recording medium by an inkjet method but also when the silver ink or the color ink is applied to the recording medium by an inkjet method.

The droplet mark 501 illustrated in FIG. 3 is observed when the silver ink is applied to a recording medium by an inkjet head. Such a droplet marks as illustrated in FIG. 3 is similarly observed when the color ink or the porous layer forming material is applied to the recording medium by an inkjet head.

Such droplet marks can be observed by, for example, using a scanning electron microscope (SEM).

Recording Device and Recording Method

The following description is based on a case in which black (K), cyan (C), magenta (M), and yellow (Y) inks are used, where each of the ink is replaceable with the ink containing silver.

The ink according to an embodiment of the present invention can be suitably applied to various recording devices employing an inkjet recording method, such as printers, facsimile machines, photocopiers, multifunction peripherals (having the functions of printer, facsimile machine, and photocopier), and three-dimensional objects manufacturing devices.

In the present disclosure, the recording device and the recording method respectively represent a device capable of discharging inks or various treatment liquids to a recording medium and a method for recording an image on the recording medium using the device. The recording medium refers to an article to which the inks or the various treatment liquids can be attached at least temporarily.

The recording device may further optionally include devices relating to feeding, conveying, and ejecting of the recording medium and other devices referred to as a pretreatment device or an aftertreatment device, in addition to the ink discharger.

The recording device may further optionally include a heater for use in the heating process and a dryer for use in the drying process. Examples of the heater and the dryer include devices for heating and drying the printed surface and the reverse surface of a recording medium. Specific examples of the heater and the dryer include, but are not limited to, a fan heater and an infrared heater. The heating process and the drying process may be performed either before, during, or after printing.

In addition, the recording device and the recording method are not limited to those producing merely meaningful visible images such as texts and figures with the ink. For example, the recording device and the recording method can produce patterns like geometric design and three-dimensional images.

The recording device includes both a serial type device in which the discharge head is caused to move and a line type device in which the discharge head is not moved.

Furthermore, in addition to the desktop type, the recording device includes a device capable of printing images on a large recording medium with A0 size and a continuous printer capable of using continuous paper reeled up in a roll form as recording media.

Figure 4:
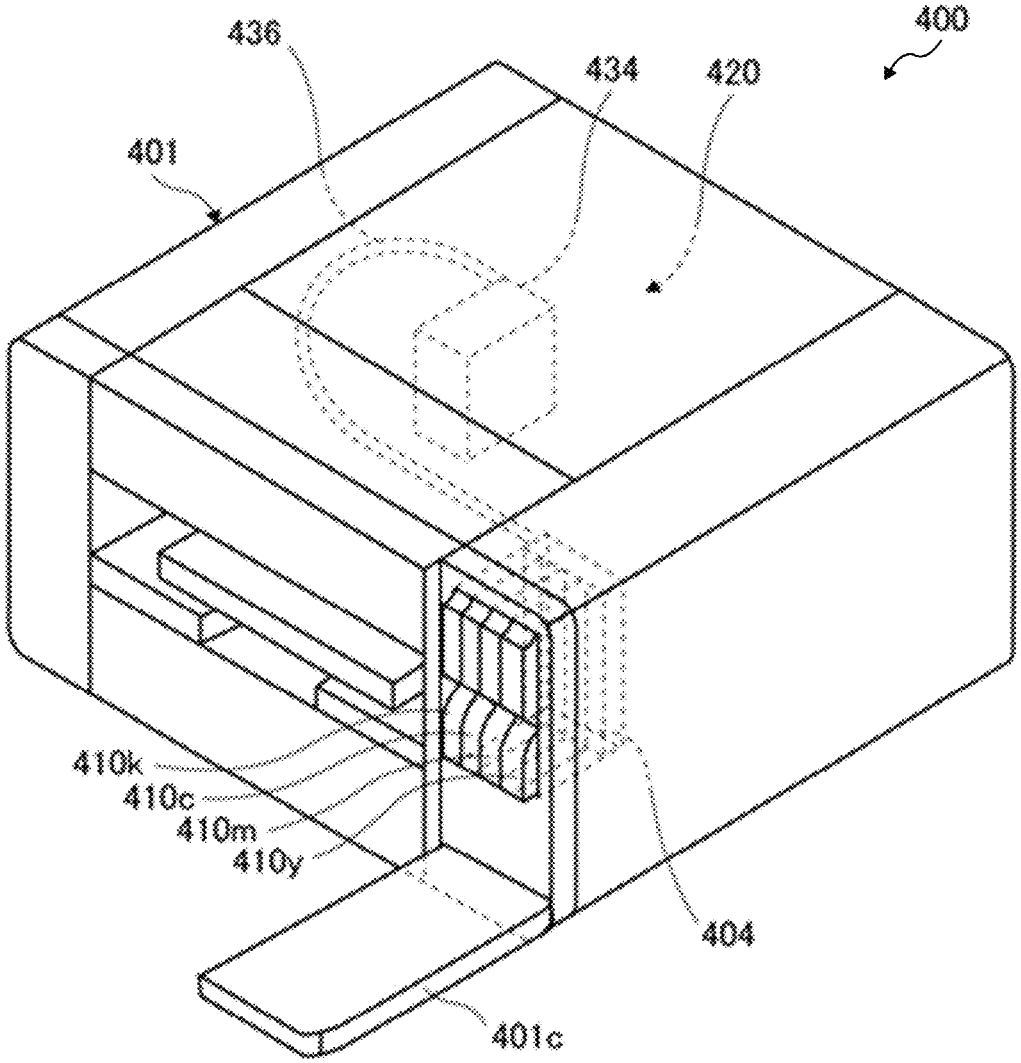
FIG. 4 is a schematic view of an image forming apparatus according to an embodiment of the present invention.
Figure 5:
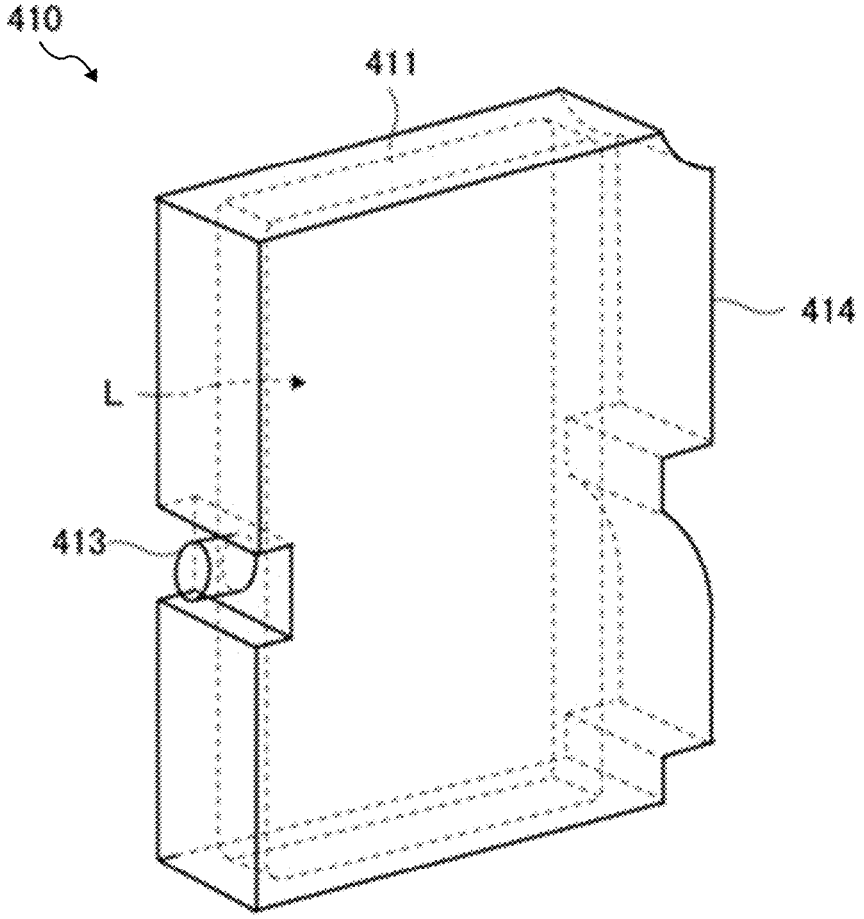
FIG. 5 is a perspective view of a main tank in the image forming apparatus illustrated in FIG. 4.

As one example of the recording device according to an embodiment of the present invention, an image forming apparatus 400 is described in detail below with reference to FIGS. 4 and 5. FIG. 4 is a perspective view of an image forming apparatus 400. FIG. 5 is a perspective view of a main tank for use in the image forming apparatus 400. The image forming apparatus 400 is a serial-type image forming apparatus. A mechanical unit 420 is disposed in a housing 401 of the image forming apparatus 400. Main tanks 410*k*, 410*c*, 410*m*, and 410*y* for respective color of black (K), cyan (C), magenta (M), and yellow (Y) (hereinafter collectively referred to as "main tank 410") each include an ink container 411. Each ink container 411 is made of a packaging member such as an aluminum laminate film The ink container 411 is accommodated in a container casing 414 made of plastic. As a result, the main tank 410 is used as an ink cartridge of each color.

A cartridge holder 404 is disposed on the rear side of the opening when a cover 401*c* is opened. The main tank 410 is detachably attachable to the cartridge holder 404. As a result, each ink discharging outlet 413 of the main tank 410 communicates with a discharge head 434 for each color via a supplying tube 436 for each color so that the ink can be discharged from the discharge head 434 to a recording medium.

The recording device according to an embodiment of the present invention may further optionally include a pretreatment device and/or an aftertreatment device, in addition to the ink discharger.

As an example, the pretreatment device and the aftertreatment device may be provided as a liquid discharger including a liquid container containing the pretreatment or aftertreatment liquid and a liquid discharge head to discharge the pretreatment or aftertreatment liquid by inkjet recording method, having a similar configuration to the liquid discharger for each of the black (K), cyan (C), magenta (M), and yellow (Y) inks.

As another example, the pretreatment device and the aftertreatment device may be provided as a device employing a method other than inkjet recording method, such as blade coating, roll coating, and spray coating.

The ink may be applied not only to inkjet recording but also to other methods in various fields. Specific examples of such methods other than inkjet recording include, but are not limited to, blade coating, gravure coating, bar coating, roll coating, dip coating, curtain coating, slide coating, die coating, and spray coating.

The applications of the ink of the present disclosure are not particularly limited. For example, the ink can be used for printed matter, paints, coating materials, and foundations. The ink can be used to form two-dimensional texts and images and furthermore three-dimensional objects.

The apparatus for manufacturing three-dimensional objects can be any known device with no particular limit. For example, the apparatus includes an ink container, a supplier, a discharger, a dryer, etc. The three-dimensional object includes an object produced by re-applying ink over and over. In addition, the three-dimensional object includes a processed product produced by processing a structure including a substrate (such as a recording medium) and an ink applied thereon. The processed product is fabricated by, for example, heat-drawing or punching a structure or recorded matter having a sheet-like form, film-like form, etc. The processed product is suitable for what is formed after surface-decorating. Examples thereof are gauges or operation panels of vehicles, office machines, electric and electronic devices, cameras, etc.

In the present disclosure, "image forming", "recording", and "printing" are treated as synonymous terms.

In addition, "recording medium", "medium", and "print medium" are synonyms.

EXAMPLES

Further understanding can be obtained by reference to certain specific examples which are provided herein for the purpose of illustration only and are not intended to be limiting.

Resin Dispersion Liquid Preparation Example 1

Preparation of Polyester Urethane Resin Dispersion Liquid 1

After replacing the air in a vessel equipped with a thermometer, a nitrogen gas inlet tube, and a stirrer with nitrogen gas, 200.4 g of polyester polyol (PTMG1000 available from Mitsubishi Chemical Corporation, having an average molecular weight of 1,000), 15.7 g of 2,2-dimethylol propionic acid, 48.0 g of isophorone diisocyanate, and 77.1 g of methyl ethyl ketone (as an organic solvent) were reacted in the vessel in the presence of 0.06 g of dibutyltin dilaurate (DMTDL available from Tokyo Chemical Industry Co., Ltd.) as a catalyst. The reaction was continued for 4 hours and 30.7 g of methyl ethyl ketone (as a diluting solvent) was added to further continue the reaction. The reaction was continued for 6 hours in total. The reaction was terminated by adding 1.4 g of methanol. Thus, an organic solvent solution of a urethane resin was obtained. Next, 13.4 g of a 48% by mass aqueous solution of potassium hydroxide was added to the organic solvent solution of the urethane resin to neutralize carboxyl groups in the urethane resin. Further, 715.3 g of water was added thereto and sufficiently stirred, followed by aging and solvent removal. Thus, a polyester urethane resin dispersion liquid 1 was prepared that contains 30% by mass of resin particles based on solid contents.

Resin Dispersion Liquid Preparation Example 2

Preparation of Polyester Urethane Resin Dispersion Liquid 2

The procedure in Resin Dispersion Liquid Preparation Example 1 was repeated except for changing the content of DMTDL from 0.06 g to 0.12 g and the total reaction time from 6 hours to 8 hours. Thus, a polyester urethane resin dispersion liquid 2 was prepared that contains 30% by mass of resin particles based on solid contents.

Resin Dispersion Liquid Preparation Example 3

Preparation of Polycarbonate Urethane Resin Dispersion Liquid 1

In a reaction vessel into which a stirrer, a reflux condenser, and a thermometer were inserted, 1,500 g of a polycarbonate diol (a reaction product of 1,6-hexanediol with dimethyl carbonate, having a number average molecular weight (Mn) of 1,200), 220 g of 2,2-dimethylolpropionic acid (DMPA), and 1,347 g of N-methylpyrrolidone (NMP) were charged under a nitrogen gas stream and heated to 60° C., and DMPA was dissolved therein.

Next, 1,445 g (5.5 mol) of 4,4'-dicyclohexylmethane diisocyanate and 2.6 g of dibutyltin dilaurate (catalyst) were added to the vessel and the mixture was heated to 90° C., so that a urethane formation reaction was carried out over 5 hours. Thus, an isocyanate-terminated urethane prepolymer was obtained. The reaction mixture was cooled to 80° C. and 149 g of triethylamine was added thereto. A part of the mixture, specifically 4,340 g of the mixture was taken out and mixed in a mixed solution of 5,400 g of water and 15 g of triethylamine under a vigorous stirring.

Subsequently, 1,500 g of ice was added and then 626 g of a 35% by mass of 2-methyl-1,5-pentanediamine aqueous solution was added to conduct a chain extension reaction, and the solvent was distilled off so that the solid content concentration became 30% by mass. Thus, a polycarbonate urethane resin dispersion liquid 1 having a structure derived from an alicyclic diisocyanate was prepared.

Resin Dispersion Liquid Preparation Example 4

Preparation of Polycarbonate Urethane Resin Dispersion Liquid 2

The procedure in Resin Dispersion Liquid Preparation Example 3 was repeated except for changing the content of dibutyltin dilaurate from 2.6 g to 2.0 g and the urethane forming reaction time from 5 hours to 4 hours. Thus, a polycarbonate urethane resin dispersion liquid 2 was prepared that contains 30% by mass of polycarbonate urethane resin particles based on solid contents.

Resin Dispersion Liquid Preparation Example 5

Preparation of Acrylic Resin Dispersion Liquid

In a reaction vessel equipped with a stirrer, a reflux condenser, a dropping device, and a thermometer, 900 g of ion-exchange water and 1 g of sodium lauryl sulfate were charged, and the temperature was raised to 70° C. while the atmosphere in the vessel was replaced with nitrogen gas and the vessel contents were stirred. While the inner temperature was kept at 70° C., 2 g of potassium persulfate as a polymerization initiator was dissolved therein, and then an emulsion that had been prepared in advance by adding 3 g of sodium lauryl sulfate, 20 g of acrylamide, 365 g of styrene, 545 g of butyl acrylate, and 10 g of methacrylic acid to 450 g of ion-exchange water was continuously dropped in the reaction solution over a period of 6 hours. After completion of the dropping, aging was carried out for 3 hours.

After the obtained aqueous particles were cooled to room temperature, ion-exchange water and sodium hydroxide aqueous solution were added to adjust the solid content concentration to 30% by mass and the pH to 8, to obtain an acrylic resin dispersion liquid containing acrylic resin particles.

SILVER DISPERSION LIQUID PREPARATION EXAMPLE

First, 66.8 g of silver nitrate, 7.2 g of a polymeric dispersant having carboxyl group (DISPERBYK 190 available from BYK Japan KK, containing water as the solvent and 40% by mass of non-volatile components, having an acid value of 10 mgKOH/g and an amine value of 0 mgKOH/g), and 1.8 g of cholic acid (available from Wako Pure Chemical Industries, Ltd.) were poured in 100 g of ion-exchange water and vigorously stirred, thus obtaining a suspension liquid. Next, 100 g of dimethylaminoethanol (available from Wako Pure Chemical Industries, Ltd.) was gradually added to the suspension liquid while keeping the liquid temperature at 50° C. or less, and thereafter heat-stirred in a water bath having a temperature of 50° C. for 3 hours, thus obtaining a reaction liquid.

The reaction liquid was filtered with a glass filter (ADVANTEC GC-90 having a pore size of 0.8 μm), thus obtaining a silver dispersion liquid containing 20% by mass of silver.

The number average particle diameter of primary particles of silver in the silver dispersion liquid was 50 nm when measured by MICROTRAK UPA available from Nikkiso Co., Ltd.

Silver Ink Preparation Example 1

Preparation of Silver Ink 1

The below-listed materials in total of 100 parts by mass were mixed and stirred and the mixture was filtered with a polypropylene filter (SYRINGE FILTER available from Sartorius AG) having an average pore diameter of 0.2 μm. Thus, a silver ink 1 was obtained.

Formulation of Silver Ink 1

Silver dispersion liquid: 50.0 parts by mass 2,4,7,9-Tetramethyldecane-4,7-diol (manufactured by Tokyo Chemical Industry Co., Ltd.): 0.5 part by mass 1,2-Propanediol diol (manufactured by Tokyo Chemical Industry Co., Ltd.): 18.0 parts by mass 3-Ethyl-3-hydroxymethyloxetane (manufactured by Tokyo Chemical Industry Co., Ltd.): 8.0 parts by mass PROXEL LV (manufactured by AVECIA GROUP) as a preservative and fungicide: 0.1 parts by mass Polyester urethane resin dispersion liquid 1: 5.0 parts by mass Ion-exchange water: a remaining amount to total of 100 parts by mass Silver Ink Preparation Examples 2 and 3

Preparation of Silver Inks 2 and 3

The procedure in Silver Ink Preparation Example 1 was repeated except for changing the ink formulation as described in Table 1, thus preparing silver inks 2 and 3.

Silver Ink Preparation Example 4

Preparation of Silver Ink 4

The below-listed materials in total of 100 parts by mass were mixed and stirred and the mixture was filtered with a polypropylene filter (SYRINGE FILTER available from Sartorius AG) having an average pore diameter of 0.2 μm. Thus, a silver ink 4 was obtained.

Formulation of Silver Ink 4

Silver nano colloid (H-1 manufactured by Mitsubishi Materials Corporation, having a silver concentration of 20% by mass): 37.5 parts by mass 2,4,7,9-Tetramethyldecane-4,7-diol (manufactured by Tokyo Chemical Industry Co., Ltd.): 0.5 part by mass 1,2-Propanediol diol (manufactured by Tokyo Chemical Industry Co., Ltd.): 27.8 parts by mass 3-Ethyl-3-hydroxymethyloxetane (manufactured by Tokyo Chemical Industry Co., Ltd.): 4.0 parts by mass PROXEL LV (manufactured by AVECIA GROUP) as a preservative and fungicide: 0.1 parts by mass Polyester urethane resin dispersion liquid 1: 0.1 parts by mass Ion-exchange water: a remaining amount to total of 100 parts by mass

TABLE 1

| | Silver Ink No. | | | |
|---|---|---|---|---|
| | Silver Ink 1 | Silver Ink 2 | Silver Ink 3 | Silver Ink 4 |
| Silver Particle Concentration (% by mass) | 10 | 5 | 5 | 7.5 |
| Silver Particle Dispersion Liquid (parts by mass) | 50 | 25 | 25 | 37.5 |
| 2,4,7,9-Tetramethyldecane-4,7-diol (parts by mass) | 0.5 | 0.5 | 0.5 | 0.5 |
| 1,2-Propanediol (parts by mass) | 18 | 25 | 25 | 27.8 |
| 3-Ethyl-3-hydroxymethyloxetane (parts by mass) | 8 | 19 | 19 | 4 |
| PROXEL LV (parts by mass) | 0.1 | 0.1 | 0.1 | 0.1 |
| Polyester Urethane Resin Dispersion Liquid 1 (parts by mass) | 5 | 2.5 | 0 | 0.1 |
| Ion-exchange Water | Remaining Amount | Remaining Amount | Remaining Amount | Remaining Amount |
| Total (parts by mass) | 100 | 100 | 100 | 100 |

Pigment Dispersion Liquid Preparation Example 1

Preparation of Pigment Dispersion Liquid 1

The below-listed materials in total of 100 parts by mass were premixed and thereafter cyclically dispersed for 7 hours in a disk type bead mill (KDL type, manufactured by Shinmaru Enterprises Corporation, filled with zirconia balls having a diameter of 0.3 mm as media). Thus, a pigment dispersion liquid 1 was obtained.

Formulation of Pigment Dispersion Liquid 1

Pigment (Pigment Blue 15:3): 15 parts by mass

Anionic surfactant (PIONIN A-51-B, manufactured by Takemoto Oil & Fat Co., Ltd.): 2 parts by mass Ion-exchange water: a remaining amount to total of 100 parts by mass Pigment Dispersion Liquid Preparation Examples 2 to 4

Preparation of Pigment Dispersion Liquids 2 to 4

The procedure in Pigment Dispersion Liquid Preparation Example 1 was repeated except for replacing the pigment with those described in Table 2, thus preparing pigment dispersion liquids 2 to 4.

Pigment Dispersion Liquid Preparation Example 5

Preparation of Pigment Dispersion Liquid 5

The below-listed materials in total of 100 parts by mass were premixed and thereafter cyclically dispersed for 7 hours in a disk type bead mill (KDL type, manufactured by Shinmaru Enterprises Corporation, filled with zirconia balls having a diameter of 0.3 mm as media) and further cyclically dispersed for 3 hours in a disk type bead mill (KDL type, manufactured by Shinmaru Enterprises Corporation, filled with zirconia balls having a diameter of 0.1 mm as media). Thus, a pigment dispersion liquid 5 was obtained.

Formulation of Pigment Dispersion Liquid 5

Pigment Blue 15:3: 15 parts by mass

Anionic surfactant (PIONIN A-51-B, manufactured by Takemoto Oil & Fat Co., Ltd.): 2 parts by mass Ion-exchange water: a remaining amount to total of 100 parts by mass Pigment Dispersion Liquid Preparation Example 6

Preparation of Pigment Dispersion Liquid 6

The below-listed materials in total of 100 parts by mass were premixed and thereafter cyclically dispersed for 5 hours in a disk type bead mill (KDL type, manufactured by Shinmaru Enterprises Corporation, filled with zirconia balls having a diameter of 1.0 mm as media). Thus, a pigment dispersion liquid 6 was obtained.

Formulation of Pigment Dispersion Liquid 6

Pigment Blue 15:3: 15 parts by mass

Anionic surfactant (PIONIN A-51-B, manufactured by Takemoto Oil & Fat Co., Ltd.): 2 parts by mass Ion-exchange water: a remaining amount to total of 100 parts by mass

TABLE 2

| Dispersion Liquid No. | Pigment Type |
|---|---|
| Pigment Dispersion Liquid 1 | Pigment Blue 15:3 |
| Pigment Dispersion Liquid 2 | Carbon Black |
| Pigment Dispersion Liquid 3 | Titanium Dioxide |

TABLE 2-continued

| Dispersion Liquid No. | Pigment Type |
|---|---|
| Pigment Dispersion Liquid 4 | Hollow Resin Emulsion |
| Pigment Dispersion Liquid 5 | Pigment Blue 15:3 |
| Pigment Dispersion Liquid 6 | Pigment Blue 15:3 |

As the pigment, the following materials were used.

Pigment Blue 15:3 (CHROMOFINE BLUE A-220JC manufactured by Dainichiseika Color & Chemicals Mfg. Co., Ltd.)

Carbon black (FW100 manufactured by Degussa)

Titanium dioxide (GTR-100 manufactured by Sakai Chemical Industry Co., Ltd.)

Hollow resin emulsion (SX-866 (B) manufactured by JSR Corporation)

Color Ink Production Example 1

Production of Color Ink 1

The below-listed materials in total of 100 parts by mass were mixed and stirred and the mixture was filtered with a polypropylene filter (SYRINGE FILTER available from Sartorius AG) having an average pore diameter of 0.2 μm. Thus, a color ink 1 was obtained.

Ink Formulation

Pigment dispersion liquid 1: 20 parts by mass

Polyester urethane resin dispersion liquid 1: 10 parts by mass

Silicone-based surfactant Shin-Etsu Silicone KF-351A (manufactured by Shin-Etsu Chemical Co., Ltd.): 1 part by mass 2,4,7,9-Tetramethyldecane-4,7-diol (manufactured by Tokyo Chemical Industry Co., Ltd.): 0.5 part by mass 1,2-Propanediol (a boiling point of 188° C.): 25 parts by mass 3-Ethyl-3-hydroxymethyloxetane (having a boiling point of 240° C., manufactured by Tokyo Chemical Industry Co., Ltd.): 15 parts by mass PROXEL LV (manufactured by AVECIA GROUP) as a preservative and fungicide: 0.1 parts by mass Ion-exchange water: a remaining amount to total of 100 parts by mass

Color Ink Production Examples 2 to 6

Production of Color Inks 2 to 6

The procedure in Color Ink Production Example 1 was repeated except for changing the ink formulation as described in Table 3, thus preparing color inks 2 to 6.

TABLE 3

| | Color Ink No. | | | | | |
|---|---|---|---|---|---|---|
| | Color Ink 1 | Color Ink 2 | Color Ink 3 | Color Ink 4 | Color Ink 5 | Color Ink 6 |
| Color Ink Type | Cyan Ink | Black Ink | White Ink | White Ink | Cyan Ink | Cyan Ink |
| Pigment Dispersion Liquid No. | Pigment Dispersion Liquid 1 | Pigment Dispersion Liquid 2 | Pigment Dispersion Liquid 3 | Pigment Dispersion Liquid 4 | Pigment Dispersion Liquid 5 | Pigment Dispersion Liquid 6 |
| Pigment Dispersion Liquid (parts by mass) | 20 | 20 | 20 | 20 | 20 | 20 |
| 2,4,7,9-Tetramethyldecane-4,7-diol (parts by mass) | 0.5 | 0.5 | 0.5 | 0.5 | 0.5 | 0.5 |
| 1,2-Propanediol (parts by mass) | 25 | 25 | 25 | 25 | 25 | 25 |
| 3-Ethyl-3-hydroxymethyl oxetane (parts by mass) | 15 | 15 | 15 | 15 | 15 | 15 |
| PROXEL LV (parts by mass) | 0.1 | 0.1 | 0.1 | 0.1 | 0.1 | 0.1 |
| Resin Dispersion Liquid Type | Polyester Urethane Resin Dispersion Liquid 1 | Polyester Urethane Resin Dispersion Liquid 2 | Polycarbonate Urethane Resin Dispersion Liquid 1 | Polycarbonate Urethane Resin Dispersion Liquid 2 | Acrylic Resin Dispersion Liquid | — |
| Resin Dispersion Liquid (parts by mass) | 10 | 10 | 10 | 10 | 10 | — |
| KF-351A (parts by mass) | 1 | 1 | 1 | 1 | 1 | 1 |
| Ion-exchange Water | Remaining Amount | Remaining Amount | Remaining Amount | Remaining Amount | Remaining Amount | Remaining Amount |
| Total (parts by mass) | 100 | 100 | 100 | 100 | 100 | 100 |

Recording Medium with Alumina-based Porous Layer Preparation Example 1

Preparation of Recording Medium M11 with Alumina-based Porous Layer

ALUMINA CLEAR SOL A2 (available from Kawaken Fine Chemicals Co., Ltd.) was mixed with 1% by mass of a surfactant (FS34 available from E. I. du Pont de Nemours and Company) to prepare a mixture liquid. The mixture liquid was applied to a vinyl chloride resin sheet (AVERY 3000 available from Avery Dennison Japan) by wire bar coating so that the average thickness of the dried porous layer became 4 μm. Thus, a recording medium M11 having an alumina-based porous layer was prepared. The surface thereof was observed with a SEM and the average pore diameter of the porous layer was determined to be 400 nm.

Recording Medium with Alumina-based Porous Layer Preparation Example 2

Preparation of Recording Medium M12 with Alumina-based Porous Layer

The procedure in Recording Medium with Alumina-based Porous Layer Preparation Example 1 was repeated except that the mixture liquid was applied such that the average thickness of the dried porous layer became 30 μm. Thus, a recording medium M12 having an alumina-based porous layer was prepared. The surface thereof was observed with a SEM and the average pore diameter of the porous layer was determined to be 400 nm.

Recording Medium with Silica-based Porous Layer Preparation Example 1

Preparation of Recording Medium M13 with Silica-based Porous Layer

SNOWTEX® UP (available from Nissan Chemical Industries, Ltd.) was mixed with 1% by mass of a surfactant (FS34 available from E. I. du Pont de Nemours and Company) to prepare a mixture liquid. The mixture liquid was applied to an OK TOP COAT paper sheet (available from Oji Paper Co., Ltd.) by wire bar coating so that the average thickness of the dried porous layer became 6 μm. Thus, a recording medium M13 having a silica-based porous layer was prepared. The surface thereof was observed with a SEM and the average pore diameter of the porous layer was determined to be 201 nm.

Recording Medium with Silica-based Porous Layer Preparation Example 2

Preparation of Recording Medium M14 with Silica-based Porous Layer

The procedure in Recording Medium with silica-based Porous Layer Preparation Example 1 was repeated except that the mixture liquid was applied such that the average thickness of the dried porous layer became 31 μm. Thus, a recording medium M14 having an silica-based porous layer was prepared. The surface thereof was observed with a SEM and the average pore diameter of the porous layer was determined to be 201 nm.

The average pore diameter and average thickness of the porous layer of each recording medium are presented in Table 4. Recording media No. M1 to M10 and M15 are commercially-available products, and recording media No. M11 to M14 were prepared in the above-described examples.

TABLE 4

| Recoding Medium No. | Recording Medium Type | Average Pore Diameter of Receiving Layer (Porous Layer) | Thickness of Receiving Layer (Porous Layer) |
|---|---|---|---|
| M1 | Glossy Paper for Inkjet (KASSAI SHASHIN-SHIAGE Pro WPA460PRO from FUJIFILM Corporation) | 300 nm | 30 μm |
| M2 | Glossy Paper for Inkjet (PLUTINUM PHOTOGRAPH PAPER EJK-QTA420 from ELECOM Co., Ltd.) | 200 nm | 15 μm |
| M3 | Glossy Paper for Inkjet (PICTORICO PHOTO PAPER PPR200-A4/20 from Pictorico) | 300 nm | 20 μm |
| M4 | Glossy Paper for Inkjet (CANON PHOTO PAPER, GLOSSY PROFESSIONAL [PLATINUM GRADE] PT-201 from Canon Inc.) | 200 nm | 20 μm |
| M5 | Vinyl Chloride Sheet (Avery3000 from Avery Dennison Japan) | No Receiving Layer | — |
| M6 | Glossyy Vinyl Chloride Film (IJ108CV310 from 3M) | No Receiving Layer | — |
| M7 | OK TOP COAT (from Oji Paper Co., Ltd.) | No Receiving Layer | — |
| M8 | PET Film (TP-188/100 from KIMOTO Co., Ltd.) | No Receiving Layer | — |
| M9 | Glossy Film (from Seiko Epson Corporation) | No Receiving Layer | — |
| M10 | Plain Paper (My Paper from Ricoh Co., Ltd.) | 20 μm | 95 μm |
| M11 | Recording Medium with Alumina-based Porous Layer Preparation Example 1 | 400 nm | 4 μm |
| M12 | Recording Medium with Alumina-based Porous Layer Preparation Example 2 | 400 nm | 30 μm |
| M13 | Recording Medium with Silica-based Porous Layer Preparation Example 1 | 201 nm | 6 μm |

TABLE 4-continued

| Recoding Medium No. | Recording Medium Type | Average Pore Diameter of Receiving Layer (Porous Layer) | Thickness of Receiving Layer (Porous Layer) |
|---|---|---|---|
| M14 | Recording Medium with Silica-based Porous Layer Preparation Example 2 | 201 nm | 31 μm |
| M15 | Inkjet Film (RM-1GP01 from Ricoh Co., Ltd.) | 230 nm | 15 μm |

It is to be noted that, in Table 4, each of M5 to M9 has no porous layer.

ALUMINA-BASED POROUS LAYER FORMING MATERIAL PREPARATION EXAMPLES

Porous Layer Forming Material Production Example 1

The below-listed materials in total of 100 parts by mass were mixed and stiffed and the mixture was filtered with a polypropylene filter (SYRINGE FILTER available from Sartorius AG) having an average pore diameter of 5 μm. Thus, a porous layer forming material 1 was obtained.

Formulation

ALUMINA CLEAR SOL A2 (manufactured by Kawaken Fine Chemicals Co., Ltd.): 70 parts by mass Surfactant EMULGEN LS-106 (manufactured by Kao Corporation): 0.8 parts by mass 1,3-Butanediol (manufactured by Tokyo Chemical Industry Co., Ltd.): 12 parts by mass Polyester urethane resin dispersion liquid 1: 2.5 parts by mass 3-Ethyl-3-hydroxymethyloxetane (manufactured by Tokyo Chemical Industry Co., Ltd.): 5 parts by mass PROXEL LV (manufactured by AVECIA GROUP) as a preservative and fungicide: 0.1 parts by mass Ion-exchange water: a remaining amount to total of 100 parts by mass

Porous Layer Forming Material Production Examples 2 and 3

The procedure in Porous Layer Forming Material Production Example 1 was repeated except for changing the formulation as described in Table 5, thus preparing porous layer forming materials 2 and 3.

TABLE 5

| | | Porous Layer Forming Material No. | | |
|---|---|---|---|---|
| | | Porous Layer Forming Material 1 | Porous Layer Forming Material 2 | Porous Layer Forming Material 3 |
| Alumina-based Main Component | Porous Main Component Product Name | ALUMINA CLEAR SOL A2 | ALUMINA CLEAR SOL 5S | ALUMINA CLEAR SOL F1000 |
| | Addition Amount (parts by mass) | 70 | 60 | 40 |
| Surfactant | Material Type | LS-106 | FS-34 | FS-34 |
| | Addition Amount (parts by mass) | 0.8 | 1 | 1 |
| Resin Dispersion Liquid | Material Type | Polyester Urethane Resin Dispersion Liquid 1 | Acrylic Resin Dispersion Liquid | — |
| | Addition Amount (parts by mass) | 2.5 | 0.5 | — |
| 1,3-Butanediol (parts by mass) | | 12 | 17.4 | 22 |
| 3-Ethyl-3-hydroxymethyloxetane (parts by mass) | | 5 | 5 | 5 |
| PROXEL LV (parts by mass) | | 0.1 | 0.1 | 0.1 |
| Ion-exchange Water (parts by mass) | | Remaining Amount | Remaining Amount | Remaining Amount |
| Total (parts by mass) | | 100 | 100 | 100 |

The following materials were used as main porous components and a surfactant for the porous layer forming materials 2 and 3.

ALUMINA CLEAR SOL 5S (manufactured by Kawaken Fine Chemicals Co., Ltd.)

ALUMINA CLEAR SOL F1000 (manufactured by Kawaken Fine Chemicals Co., Ltd.)

FS-3434 (manufactured by E. I. du Pont de Nemours and Company)

SILICA-BASED POROUS LAYER FORMING MATERIAL PREPARATION EXAMPLES

Porous Layer Forming Material Production Example 4

The below-listed materials in total of 100 parts by mass were mixed and stirred and the mixture was filtered with a polypropylene filter (SYRINGE FILTER available from Sartorius AG) having an average pore diameter of 5 μm. Thus, a porous layer forming material 4 was obtained.

Formulation

SNOWTEX® UP (manufactured by Nissan Chemical Industries, Ltd.): 60 parts by mass Surfactant FS-34 (manufactured by E. I. du Pont de Nemours and Company): 1 part by mass 1,3-Butanediol (manufactured by Tokyo Chemical Industry Co., Ltd.): 13 parts by mass Polyester urethane resin dispersion liquid 2: 6 parts by mass 3-Ethyl-3-hydroxymethyloxetane (manufactured by Tokyo Chemical Industry Co., Ltd.): 5 parts by mass PROXEL LV (manufactured by AVECIA GROUP) as a preservative and fungicide: 0.1 parts by mass Ion-exchange water: a remaining amount to total of 100 parts by mass

Porous Layer Forming Material Production Examples 5 and 6

The procedure in Porous Layer Forming Material Production Example 4 was repeated except for changing the formulation as described in Table 6, thus preparing porous layer forming materials 5 and 6.

TABLE 6

| | | Porous Layer Forming Material No. | | |
|---|---|---|---|---|
| | | Porous Layer Forming Material 4 | Porous Layer Forming Material 5 | Porous Layer Forming Material 6 |
| Silica-based Main Component | Porous Main Component Product Name | SNOWTEX ® S | SNOWTEX ® UP | CATALOID SI-30 |
| | Addition Amount (parts by mass) | 60 | 65 | 35 |
| Surfactant | Material Type | FS-34 | FS-34 | LS-106 |
| | Addition Amount (parts by mass) | 1 | 1 | 1 |
| Resin Dispersion Liquid | Material Type | Polyester Urethane Resin Dispersion Liquid 2 | Polycarbonate Urethane Resin Dispersion Liquid 2 | — |
| | Addition Amount (parts by mass) | 6 | 0.2 | — |
| 1,3-Butanediol (parts by mass) | | 13 | 11.7 | 27.4 |
| 3-Ethyl-3-hydroxymethyloxetane (parts by mass) | | 5 | 5 | 4 |
| PROXEL LV (parts by mass) | | 0.1 | 0.1 | 0.1 |
| Ion-exchange Water (parts by mass) | | Remaining Amount | Remaining Amount | Remaining Amount |
| Total (parts by mass) | | 100 | 100 | 100 |

The following materials were used as main porous components for the porous layer forming materials 5 and 6.

SNOWTEX® UP (manufactured by Nissan Chemical Industries, Ltd.)

CATALOID SI-30 (manufactured by JGC Catalysts & Chemicals Incorporation)

Examples 1 to 42

A solid image was printed on the recoding medium described in Table 7 with the porous layer forming material described in Table 7 using an inkjet printer (IPSiO GXe 5500 manufactured by Ricoh Co., Ltd.) at 25° C., followed by drying, thus forming a porous layer.

Next, solid images of the silver ink and the color ink described in Table 8 were printed on the above-formed porous layer, in the order described in Table 8, using the inkjet printer (IPSiO GXe 5500 manufactured by Ricoh Co., Ltd.) at 25° C., followed by drying.

In some Examples, a laminate layer was further formed on the print layer by lamination-coating the print layer with the material described in table 8 so as to have an average thickness described in Table 8. Thus, recorded matter having a laminate layer (resin layer) on the print layer was obtained.

Comparative Examples 1 to 17

Recorded matters of Comparative Examples 1 to 17 were obtained in the same manner as in Examples 1 to 42 using the inkjet printer (IPSiO GXe 5500 manufactured by Ricoh Co., Ltd.) except that the conditions were changed according to Tables 9 and 10.

The average pore diameter and average thickness of the porous layer, as well as droplet marks, of the recorded matter were measured from a SEM image of the surface of the recorded matter, particularly a 10-μm-square porous region where no ink was deposited on the surface of the recorded matter. The results are presented in Tables 7 and 9.

Average Pore Diameter of Porous Layer

First, the lengths of the longest and shortest diagonal lines for all of the pores (voids) observed in the 10-μm square region on the surface of the recorded matter observed by SEM were measured and averaged to determine a pore diameter of each pore. The average pore diameter of the porous layer was calculated by averaging the pore diameters thus determined. In calculating the average pore diameter, the pore diameters equal to or less than 100 nm were not taken into consideration for the calculation.

Average Thickness of Porous Layer

The average thickness of the porous layer was calculated from a SEM image of a cross-sectional surface of the recorded matter. Specifically, the average of the thicknesses at the following three points in the cross-sectional surface of the recorded matter was determined: a midpoint M1 of the cross-sectional surface of the recorded matter, a midpoint M2 between one end of the the cross-sectional surface of the recorded matter and the midpoint M1, and a midpoint M3 between the other end of the the cross-sectional surface of the recorded matter and the midpoint M1. Regions in the porous layer where the average pore diameter is not greater than 200 nm or greater than 400 nm were not taken into consideration in calculating the average thickness of the porous layer.

Evaluation of Droplet Marks being Porous

A scanning electron microscope (SEM) image of the surface of the recorded matter as illustrated in FIG. 3 was observed to determine whether or not multiple (two or more) droplet marks having a substantially circular shape that are porous were present.

TABLE 7

| | Recoding Medium | | | | Porous Layer | | | |
|---|---|---|---|---|---|---|---|---|
| | No. | Average Pore Diameter of Porous Layer (nm) | Average Thickness of Porous Layer (μm) | Porous Layer Forming Material | Average Pore Diameter of Porous Layer (nm) | Average Thickness of Porous Layer (μm) | Presence or Absence | Droplet Mark |
| Example 1 | M5 | — | — | Porous Layer Forming Material 1 | 320 | 28 | Present | Present |
| Example 2 | M5 | — | — | Porous Layer Forming Material 2 | 360 | 8 | Present | Present |
| Example 3 | M5 | — | — | Porous Layer Forming Material 1 | 320 | 7 | Present | Present |
| Example 4 | M5 | — | — | Porous Layer Forming Material 4 | 280 | 30 | Present | Present |
| Example 5 | M6 | — | — | Porous Layer Forming Material 2 | 300 | 10 | Present | Present |
| Example 6 | M6 | — | — | Porous Layer Forming Material 6 | 201 | 25 | Present | Present |
| Example 7 | M6 | — | — | Porous Layer Forming Material 1 | 280 | 25 | Present | Present |
| Example 8 | M6 | — | — | Porous Layer Forming Material 2 | 320 | 6 | Present | Present |
| Example 9 | M7 | — | — | Porous Layer Forming Material 1 | 220 | 6 | Present | Present |
| Example 10 | M7 | — | — | Porous Layer Forming Material 2 | 240 | 5 | Present | Present |
| Example 11 | M7 | — | — | Porous Layer Forming Material 4 | 260 | 28 | Present | Present |
| Example 12 | M7 | — | — | Porous Layer Forming Material 6 | 205 | 28 | Present | Present |
| Example 13 | M8 | — | — | Porous Layer Forming Material 1 | 220 | 7 | Present | Present |
| Example 14 | M8 | — | — | Porous Layer Forming Material 2 | 250 | 7 | Present | Present |
| Example 15 | M8 | — | — | Porous Layer Forming Material 1 | 220 | 6 | Present | Present |
| Example 16 | M8 | — | — | Porous Layer Forming Material 4 | 270 | 28 | Present | Present |
| Example 17 | M9 | — | — | Porous Layer Forming Material 4 | 330 | 28 | Present | Present |
| Example 18 | M9 | — | — | Porous Layer Forming Material 6 | 360 | 25 | Present | Present |
| Example 19 | M9 | — | — | Porous Layer Forming Material 1 | 300 | 27 | Present | Present |
| Example 20 | M9 | — | — | Porous Layer Forming Material 2 | 320 | 7 | Present | Present |
| Example 21 | M1 | 300 | 30 | Porous Layer Forming Material 1 | 350 | 26 | Present | Present |
| Example 22 | M2 | 200 | 15 | Porous Layer Forming Material 4 | 390 | 25 | Present | Present |
| Example 23 | M3 | 300 | 20 | Porous Layer Forming Material 4 | 380 | 26 | Present | Present |
| Example 24 | M4 | 200 | 20 | Porous Layer Forming Material 6 | 360 | 25 | Present | Present |

TABLE 7-continued

| | Recoding Medium | | | | Porous Layer | | | |
|---|---|---|---|---|---|---|---|---|
| | No. | Average Pore Diameter of Porous Layer (nm) | Average Thickness of Porous Layer (μm) | Porous Layer Forming Material | Average Pore Diameter of Porous Layer (nm) | Average Thickness of Porous Layer (μm) | Presence or Absence | Droplet Mark |
| Example 25 | M11 | 400 | 4 | Porous Layer Forming Material 4 | 300 | 25 | Present | Present |
| Example 26 | M12 | 400 | 30 | Porous Layer Forming Material 6 | 380 | 25 | Present | Present |
| Example 27 | M13 | 201 | 6 | Porous Layer Forming Material 4 | 320 | 25 | Present | Present |
| Example 28 | M14 | 201 | 31 | Porous Layer Forming Material 6 | 390 | 25 | Present | Present |
| Example 29 | M11 | 400 | 4 | Porous Layer Forming Material 1 | 390 | 27 | Present | Present |
| Example 30 | M12 | 400 | 30 | Porous Layer Forming Material 2 | 390 | 10 | Present | Present |
| Example 31 | M13 | 201 | 6 | Porous Layer Forming Material 1 | 210 | 23 | Present | Present |
| Example 32 | M14 | 201 | 31 | Porous Layer Forming Material 2 | 250 | 7 | Present | Present |
| Example 33 | M11 | 400 | 4 | Porous Layer Forming Material 4 | 395 | 27 | Present | Present |
| Example 34 | M12 | 400 | 30 | Porous Layer Forming Material 6 | 399 | 25 | Present | Present |
| Example 35 | M13 | 201 | 6 | Porous Layer Forming Material 1 | 205 | 28 | Present | Present |
| Example 36 | M14 | 201 | 31 | Porous Layer Forming Material 6 | 202 | 29 | Present | Present |
| Example 37 | M6 | — | — | Porous Layer Forming Material 2 | 320 | 6 | Present | Present |
| Example 38 | M5 | — | — | Porous Layer Forming Material 1 | 280 | 28 | Present | Present |
| Example 39 | M5 | — | — | Porous Layer Forming Material 1 | 350 | 28 | Present | Present |
| Example 40 | M5 | — | — | Porous Layer Forming Material 1 | 250 | 28 | Present | Present |
| Example 41 | M5 | — | — | Porous Layer Forming Material 1 | 280 | 20 | Present | Present |
| Example 42 | M5 | — | — | Porous Layer Forming Material 1 | 280 | 30 | Present | Present |

TABLE 8

| | | | | Resin Coating (Laminate) Layer | | |
|---|---|---|---|---|---|---|
| | Silver Ink | Color Ink | Ink Discharge Order | Presence or Absence of Resin Coating Layer | Coating Material | Average Thickness of Resin Coating Layer (μm) |
| Example 1 | Silver Ink 1 | Color Ink 1 | Silver -> Color | Present | PET | 100 |
| Example 2 | Silver Ink 2 | Color Ink 2 | Silver -> Color | Present | Polypropylene | 200 |
| Example 3 | Silver Ink 3 | Color Ink 3 | Silver -> Color | Present | PET | 200 |
| Example 4 | Silver Ink 4 | Color Ink 4 | Silver -> Color | Present | Polypropylene | 150 |
| Example 5 | Silver Ink 1 | Color Ink 5 | Silver -> Color | Present | PET | 6 |
| Example 6 | Silver Ink 2 | Color Ink 6 | Silver -> Color | Present | Polypropylene | 300 |
| Example 7 | Silver Ink 3 | Color Ink 1 | Silver -> Color | Present | PET | 5 |
| Example 8 | Silver Ink 4 | Color Ink 2 | Silver -> Color | Present | Polypropylene | 250 |
| Example 9 | Silver Ink 1 | Color Ink 3 | Silver -> Color | Present | PET | 280 |
| Example 10 | Silver Ink 2 | Color Ink 4 | Silver -> Color | Present | Polypropylene | 7 |
| Example 11 | Silver Ink 3 | Color Ink 5 | Silver -> Color | Present | PET | 10 |
| Example 12 | Silver Ink 4 | Color Ink 6 | Silver -> Color | Present | Polypropylene | 20 |
| Example 13 | Silver Ink 1 | Color Ink 1 | Silver -> Color | Present | PET | 50 |

TABLE 8-continued

| | | | | Resin Coating (Laminate) Layer | | |
|---|---|---|---|---|---|---|
| | Silver Ink | Color Ink | Ink Discharge Order | Presence or Absence of Resin Coating Layer | Coating Material | Average Thickness of Resin Coating Layer (μm) |
| Example 14 | Silver Ink 2 | Color Ink 2 | Silver -> Color | Present | Polypropylene | 80 |
| Example 15 | Silver Ink 3 | Color Ink 3 | Silver -> Color | Present | PET | 150 |
| Example 16 | Silver Ink 4 | Color Ink 4 | Silver -> Color | Present | Polypropylene | 250 |
| Example 17 | Silver Ink 1 | Color Ink 5 | Silver -> Color | Absent | — | — |
| Example 18 | Silver Ink 2 | Color Ink 6 | Silver -> Color | Absent | — | — |
| Example 19 | Silver Ink 3 | Color Ink 1 | Silver -> Color | Absent | — | — |
| Example 20 | Silver Ink 4 | Color Ink 2 | Silver -> Color | Absent | — | — |
| Example 21 | Silver Ink 1 | Color Ink 3 | Silver -> Color | Present | PET | 100 |
| Example 22 | Silver Ink 2 | Color Ink 4 | Silver -> Color | Present | Polypropylene | 200 |
| Example 23 | Silver Ink 3 | Color Ink 5 | Silver -> Color | Present | PET | 200 |
| Example 24 | Silver Ink 4 | Color Ink 6 | Silver -> Color | Present | Polypropylene | 150 |
| Example 25 | Silver Ink 1 | Color Ink 1 | Silver -> Color | Present | PET | 6 |
| Example 26 | Silver Ink 2 | Color Ink 2 | Silver -> Color | Present | Polypropylene | 300 |
| Example 27 | Silver Ink 3 | Color Ink 3 | Silver -> Color | Present | PET | 5 |
| Example 28 | Silver Ink 4 | Color Ink 4 | Silver -> Color | Present | Polypropylene | 298 |
| Example 29 | Silver Ink 1 | Color Ink 5 | Color -> Silver | Present | PET | 299 |
| Example 30 | Silver Ink 2 | Color Ink 6 | Color -> Silver | Present | Polypropylene | 7 |
| Example 31 | Silver Ink 3 | Color Ink 1 | Color -> Silver | Present | PET | 10 |
| Example 32 | Silver Ink 4 | Color Ink 2 | Color -> Silver | Present | Polypropylene | 20 |
| Example 33 | Silver Ink 1 | Color Ink 3 | Simultaneous | Present | PET | 50 |
| Example 34 | Silver Ink 2 | Color Ink 4 | Simultaneous | Present | Polypropylene | 80 |
| Example 35 | Silver Ink 3 | Color Ink 5 | Simultaneous | Present | PET | 150 |
| Example 36 | Silver Ink 4 | Color Ink 6 | Simultaneous | Present | Polypropylene | 250 |
| Example 37 | Silver Ink 4 | Not Printed | Silver Only | Present | Polypropylene | 250 |
| Example 38 | Silver Ink 1 | Not Printed | Silver Only | Present | PET | 100 |
| Example 39 | Silver Ink 1 | Not Printed | Silver Only | Present | PET | 100 |
| Example 40 | Silver Ink 1 | Not Printed | Silver Only | Present | PET | 100 |
| Example 41 | Silver Ink 1 | Not Printed | Silver Only | Present | PET | 100 |
| Example 42 | Silver Ink 1 | Not Printed | Silver Only | Present | PET | 100 |

TABLE 9

| | Recoding Medium | | | | Porous Layer | | | |
|---|---|---|---|---|---|---|---|---|
| | No. | Average Pore Diameter of Porous Layer (nm) | Average Thickness of Porous Layer (μm) | Porous Layer Forming Material | Average Pore Diameter of Porous Layer (nm) | Average Thickness of Porous Layer (μm) | Presence or Absence | Droplet Mark |
| Comparative Example 1 | M5 | — | — | Porous Layer Forming Material 3 | 401 | 50 | Present | Present |
| Comparative Example 2 | M5 | — | — | Porous Layer Forming Material 5 | 400 | 31 | Present | Present |
| Comparative Example 3 | M5 | — | — | Not Used | — | — | Absent | Absent |
| Comparative Example 4 | M6 | — | — | Not Used | — | — | Absent | Absent |
| Comparative Example 5 | M7 | — | — | Not Used | — | — | Absent | Absent |
| Comparative Example 6 | M8 | — | — | Not Used | — | — | Absent | Absent |
| Comparative Example 7 | M10 | 20000 | 95 | Porous Layer Forming Material 1 | 200 | 4 | Present | Present |
| Comparative Example 8 | M10 | 20000 | 95 | Porous Layer Forming Material 6 | 201 | 31 | Present | Present |
| Comparative Example 9 | M9 | — | — | Not Used | — | — | Absent | Absent |
| Comparative Example 10 | M8 | — | — | Not Used | — | — | Absent | Absent |
| Comparative Example 11 | M9 | — | — | Not Used | — | — | Absent | Absent |
| Comparative Example 12 | M6 | — | — | Not Used | — | — | Absent | Absent |
| Comparative Example 13 | M14 | 201 | 31 | Not Used | — | — | Absent | Absent |
| Comparative Example 14 | M5 | — | — | Porous Layer Forming Material 1 | 401 | 28 | Present | Present |
| Comparative Example 15 | M5 | — | — | Porous Layer Forming Material 1 | 200 | 28 | Present | Present |
| Comparative Example 16 | M5 | — | — | Porous Layer Forming Material 1 | 320 | 4 | Present | Present |
| Comparative Example 17 | M5 | — | — | Porous Layer Forming Material 1 | 320 | 31 | Present | Present |

TABLE 10

| | | | | Resin Coating (Laminate) Layer | | |
|---|---|---|---|---|---|---|
| | Silver Ink | Color Ink | Ink Discharge Order | Presence or Absence of Resin Coating Layer | Coating Material | Average Thickness of Resin Coating Layer (μm) |
| Comparative Example 1 | Silver Ink 1 | Color Ink 3 | Silver -> Color | Present | PET | 200 |
| Comparative Example 2 | Silver Ink 2 | Color Ink 4 | Silver -> Color | Present | Polypropylene | 100 |
| Comparative Example 3 | Silver Ink 3 | Color Ink 6 | Silver -> Color | Absent | — | — |
| Comparative Example 4 | Silver Ink 2 | Color Ink 4 | Silver -> Color | Present | PET | 4.5 |
| Comparative Example 5 | Silver Ink 3 | Color Ink 5 | Silver -> Color | Present | Polypropylene | 250 |
| Comparative Example 6 | Silver Ink 4 | Color Ink 6 | Silver -> Color | Present | PET | 280 |

TABLE 10-continued

| | Silver Ink | Color Ink | Ink Discharge Order | Resin Coating (Laminate) Layer: Presence or Absence of Resin Coating Layer | Coating Material | Average Thickness of Resin Coating Layer (μm) |
|---|---|---|---|---|---|---|
| Comparative Example 7 | Silver Ink 3 | Color Ink 5 | Simultaneous | Present | PET | 301 |
| Comparative Example 8 | Silver Ink 4 | Color Ink 6 | Simultaneous | Present | Polypropylene | 302 |
| Comparative Example 9 | Silver Ink 1 | Color Ink 1 | Silver -> Color | Present | Polypropylene | 4 |
| Comparative Example 10 | Silver Ink 3 | Color Ink 6 | Silver -> Color | Present | PET | 100 |
| Comparative Example 11 | Silver Ink 3 | Color Ink 6 | Silver -> Color | Present | Polypropylene | 200 |
| Comparative Example 12 | Silver Ink 1 | Color Ink 1 | Silver -> Color | Present | PET | 100 |
| Comparative Example 13 | Silver Ink 1 | Color Ink 1 | Silver -> Color | Present | Polypropylene | 200 |
| Comparative Example 14 | Silver Ink 1 | Color Ink 1 | Silver -> Color | Present | PET | 100 |
| Comparative Example 15 | Silver Ink 1 | Color Ink 1 | Silver -> Color | Present | PET | 100 |
| Comparative Example 16 | Silver Ink 1 | Color Ink 1 | Silver -> Color | Present | PET | 100 |
| Comparative Example 17 | Silver Ink 1 | Color Ink 1 | Silver -> Color | Present | PET | 100 |

Next, various properties of the recorded matter were evaluated as follows. The results are summarized in Tables 11 and 12.

Incidentally, each evaluation was performed after drying of the recorded matter, and in the case of performing the lamination treatment, evaluation was performed after the lamination treatment.

Evaluation of Scratch Resistance

Each recorded matter after being dried was set in a Color Fastness Rubbing Tester AB-301 (available from TESTER SANGYO CO., LTD.) and rubbed 10 times with a friction element (with a load of 300 g), to the contact part of which a white cotton cloth (according to JIS L 0803) was attached. The degree of deterioration was visually observed to evaluate scratch resistance based on the following criteria. The ranks S, A, and B, preferably the ranks S and A, are levels at which there is no problem in practical use.

Evaluation Criteria

S: The number of flaws is less than 5 and the background is invisible.

A: The number of flaws is 5 or more and less than 10 and the background is invisible.

B: The number of flaws is 10 or more and the rate of exposure of the background is less than 5%.

B: The number of flaws is 10 or more and the rate of exposure of the background is 5% or more.

Evaluation of Gloss Value

The 20° gloss value of each recorded matter was measured with a gloss meter (micro-TRI-gloss available from BYK-Gardener) and evaluated based on the following criteria. The ranks S, A, and B, preferably the ranks S and A, are levels at which there is no problem in practical use.

Evaluation Criteria

S: The 20° gloss value is 800 or more.

A: The 20° gloss value is 500 or more and less than 800.

B: The 20° gloss value is 250 or more and less than 500.

C: The 20° gloss value is less than 250.

Evaluation of Image Clarity

The image clarity value C of each recorded matter was measured according to the image clarity measurement method prescribed in JIS-H8686-2 under the optical comb width of 2.0 mm using an image clarity meter ICM-1 (available from Suga Test Instruments Co., Ltd.) and evaluated based on the following criteria. The ranks S, A, and B, preferably the ranks S and A, are levels at which there is no problem in practical use.

Evaluation Criteria

S: The image clarity value C is 50 or more.

A: The image clarity value C is 30 or more and less than 50.

B: The image clarity value C is 5 or more and less than 30.

C: The image clarity value C is less than 5.

TABLE 11

| | Evaluation: Scratch Resistance | Gloss Value | Image Clarity |
|---|---|---|---|
| Example 1 | S | S | S |
| Example 2 | S | A | A |
| Example 3 | S | A | A |
| Example 4 | S | S | S |
| Example 5 | S | A | A |
| Example 6 | S | A | A |
| Example 7 | S | S | S |
| Example 8 | S | A | A |
| Example 9 | S | A | A |
| Example 10 | S | A | A |
| Example 11 | S | S | S |
| Example 12 | S | A | A |
| Example 13 | S | A | A |
| Example 14 | 5 | A | A |
| Example 15 | S | A | A |
| Example 16 | S | S | S |
| Example 17 | A | S | S |

TABLE 11-continued

| | Evaluation | | |
|---|---|---|---|
| | Scratch Resistance | Gloss Value | Image Clarity |
| Example 18 | A | S | S |
| Example 19 | A | S | S |
| Example 20 | A | A | A |
| Example 21 | S | S | S |
| Example 22 | S | A | A |
| Example 23 | S | A | A |
| Example 24 | S | S | S |
| Example 25 | S | S | S |
| Example 26 | S | B | B |
| Example 27 | S | S | S |
| Example 28 | S | B | B |
| Example 29 | S | B | B |
| Example 30 | S | B | B |
| Example 31 | S | A | A |
| Example 32 | S | B | B |
| Example 33 | S | B | B |
| Example 34 | S | B | B |
| Example 35 | S | B | B |
| Example 36 | S | B | B |
| Example 37 | S | A | A |
| Example 38 | S | S | S |
| Example 39 | S | S | S |
| Example 40 | S | S | S |
| Example 41 | S | S | S |
| Example 42 | S | S | S |

TABLE 12

| | Evaluation | | |
|---|---|---|---|
| | Scratch Resistance | Gloss Value | Image Clarity |
| Comparative Example 1 | S | A | C |
| Comparative Example 2 | S | A | C |
| Comparative Example 3 | C | C | C |
| Comparative Example 4 | B | C | C |
| Comparative Example 5 | S | C | C |
| Comparative Example 6 | S | C | C |
| Comparative Example 7 | S | C | C |
| Comparative Example 8 | S | C | C |
| Comparative Example 9 | B | C | C |
| Comparative Example 10 | S | C | C |
| Comparative Example 11 | S | C | C |
| Comparative Example 12 | S | C | C |
| Comparative Example 13 | A | A | C |
| Comparative Example 14 | S | B | C |
| Comparative Example 15 | S | B | C |
| Comparative Example 16 | S | B | C |
| Comparative Example 17 | S | C | C |

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. An image forming method, comprising:

applying a porous layer forming material to a recording medium by an inkjet head to form a porous layer having an average pore diameter greater than 200 nm and not greater than 400 nm and an average thickness of from 5 to 30 μm;

applying a silver ink containing silver to the porous layer to form a silver layer on the porous layer; and applying a color ink containing a colorant to the silver layer.

2. The image forming method of claim 1, wherein the porous layer forming material comprises at least one of alumina and silica.

3. The image forming method of claim 1, wherein the average pore diameter is from 250 to 360 nm and the average thickness is from 20 to 30 μm.

4. The image forming method of claim 1, wherein each of the silver ink and the color ink independently comprises a resin.

5. The image forming method of claim 1, wherein the applying the color ink is conducted after the applying the silver ink.

6. The image forming method of claim 1, wherein the recording medium comprises an impermeable substrate.

7. The image forming method of claim 6, wherein the impermeable substrate comprises a plastic film.

8. The image forming method of claim 1, further comprising forming a laminate layer on a region where the silver ink is applied.

9. The image forming method of claim 8, wherein the laminate layer s transparent, and comprise at least one resin selected from the group consisting of polyethylene terephthalate, polypropylene, and nylon.

10. The image forming method of claim 1, wherein said porous layer comprises a sol-like or gel-like structure.

11. The image forming method of claim 1, wherein said silver ink contains silver and 1,2-propanediol.

12. The image forming method of claim 1, wherein said silver ink comprises silver particles having a number average particle diameter of 15 to 100 nm.

* * * * *